US011480197B2

(12) United States Patent
Kawamoto et al.

(10) Patent No.: US 11,480,197 B2
(45) Date of Patent: Oct. 25, 2022

(54) EJECTOR MODULE

(71) Applicant: DENSO CORPORATION, Kariya (JP)

(72) Inventors: Yoichiro Kawamoto, Kariya (JP); Gota Ogata, Kariya (JP); Hiroshi Oshitani, Kariya (JP); Ryu Fukushima, Kariya (JP); Teruyuki Hotta, Kariya (JP); Tatsuhiro Suzuki, Kariya (JP); Hang Yuan, Kariya (JP); Daisuke Sakurai, Kariya (JP); Masahiro Ito, Kariya (JP); Hiroshi Maeda, Kariya (JP)

(73) Assignee: DENSO CORPORATION, Kariya (JP)

( * ) Notice: Subject to any disclaimer, the term of this patent is extended or adjusted under 35 U.S.C. 154(b) by 544 days.

(21) Appl. No.: 16/557,685

(22) Filed: Aug. 30, 2019

(65) Prior Publication Data

US 2019/0383308 A1 Dec. 19, 2019

Related U.S. Application Data

(63) Continuation of application No. PCT/JP2018/005440, filed on Feb. 16, 2018.

(30) Foreign Application Priority Data

Mar. 2, 2017 (JP) ..... JP2017-039252
Jun. 21, 2017 (JP) ..... JP2017-121448

(51) Int. Cl.
*F04F 5/04* (2006.01)
*F25B 41/24* (2021.01)
(Continued)

(52) U.S. Cl.
CPC ..... *F04F 5/04* (2013.01); *F04F 5/20* (2013.01); *F25B 41/24* (2021.01); *F04F 5/461* (2013.01); *F25B 1/10* (2013.01); *F25B 5/04* (2013.01)

(58) Field of Classification Search
CPC ..... F04F 5/04; F04F 5/20; F04F 5/461; F25B 1/10; F25B 5/04; F25B 9/08; F25B 9/10;
(Continued)

(56) References Cited

U.S. PATENT DOCUMENTS 7,520,142 B2 * 4/2009 Saito ..... F25B 5/04 62/500
10,843,528 B2 * 11/2020 Tan ..... B60H 1/22
(Continued)

FOREIGN PATENT DOCUMENTS

JP 2008303851 A * 12/2008 ..... F25B 41/00
JP 4259531 B2 4/2009
(Continued)

OTHER PUBLICATIONS

Written Opinion of the International Searching Authority (English Translation), International App. No. PCT/JP2018/005440 (Year: 2018).*

(Continued)

*Primary Examiner* — Miguel A Diaz
(74) *Attorney, Agent, or Firm* — Harness, Dickey & Pierce, P.L.C.

(57) ABSTRACT

When an ejector having a variable nozzle and a variable throttle mechanism are integrated together as an ejector module, a nozzle-side central axis CL1 and a decompression-side driving mechanism have a twisted positional relationship, if the nozzle-side central axis CL1 is defined as a central axis of a nozzle-side driving mechanism in a displacement direction in which the nozzle-side driving mechanism of the ejector having the variable nozzle displaces a needle valve, and the decompression-side central axis CL2 is defined as a central axis of a decompression-side driving mechanism in a displacement direction in which the decompression-side driving mechanism of the variable throttle
(Continued)

mechanism displaces a throttle valve. When viewed from the central axis direction of one of the nozzle-side central axis CL1 and the decompression-side central axis CL2, a driving portion corresponding to the one central axis is disposed to overlap with the other central axis.

20 Claims, 12 Drawing Sheets

(51) Int. Cl.

| | |
|---|---|
| ***F25B 5/04*** | (2006.01) |
| ***F04F 5/46*** | (2006.01) |
| ***F04F 5/20*** | (2006.01) |
| *F25B 1/10* | (2006.01) |

(58) Field of Classification Search
CPC ..... F25B 2341/00; F25B 2341/001; F25B 2400/0407
See application file for complete search history.

(56) References Cited

U.S. PATENT DOCUMENTS

2006/0218964 A1* 10/2006 Saito ..... F25B 5/04 62/500
2006/0254308 A1* 11/2006 Yokoyama ..... F25D 21/08 62/500
2007/0163294 A1* 7/2007 Aung ..... F25B 41/00 62/500
2007/0169510 A1* 7/2007 Ishizaka ..... F25B 39/02 62/500
2007/0169512 A1* 7/2007 Ishizaka ..... F28D 1/05391 62/515
2008/0264097 A1 10/2008 Ishizaka et al.
2009/0229304 A1* 9/2009 Ogata ..... F25B 41/00 239/589
2019/0383308 A1* 12/2019 Kawamoto ..... F04F 5/20

FOREIGN PATENT DOCUMENTS

JP 2010133577 A * 6/2010
JP 2018146140 A 9/2018
JP 2018146219 A * 9/2018 ..... F04F 5/04
WO WO-2013128529 A1 * 9/2013 ..... F25B 41/00
WO WO-2016043407 A1 * 3/2016 ..... F25B 29/003
WO WO-2018159320 A1 9/2018
WO WO-2018159322 A1 9/2018
WO WO-2018159323 A1 9/2018

OTHER PUBLICATIONS

International Search Report (English Translation), International App. No. PCT/JP2018/005540 (Year: 2018).*

* cited by examiner

EJECTOR MODULE

CROSS REFERENCE TO RELATED APPLICATION

The present application is a continuation application of International Patent Application No. PCT/JP2018/005440 filed on Feb. 16, 2018, which designated the U.S. and claims the benefit of priority from Japanese Patent Applications No. 2017-039252 filed on Mar. 2, 2017 and No. 2017-121448 filed on Jun. 21, 2017. The entire disclosures of all of the above applications are incorporated herein by reference.

TECHNICAL FIELD

The present disclosure relates to an ejector module for use in an ejector refrigeration cycle.

BACKGROUND

Conventionally, an ejector refrigeration cycle is known as a refrigeration cycle device that includes an ejector serving as a refrigerant decompression device. In this kind of ejector refrigeration cycle, the pressure of a refrigerant drawn into a compressor can be increased more than an evaporation pressure of the refrigerant in an evaporator by a pressurizing effect of the ejector. Thus, the ejector refrigeration cycle can reduce the power consumption of the compressor to improve the coefficient of performance (COP) of the cycle.

SUMMARY

An ejector module may include a decompression portion, a decompression-side valve body and a decompression-side driving portion, so that it can configure a variable throttle mechanism. A throttle opening degree of the variable throttle mechanism may be changed in accordance with variations in the load on an ejector refrigeration cycle that uses the ejector module.

DESCRIPTION OF EMBODIMENTS

Figure 1:
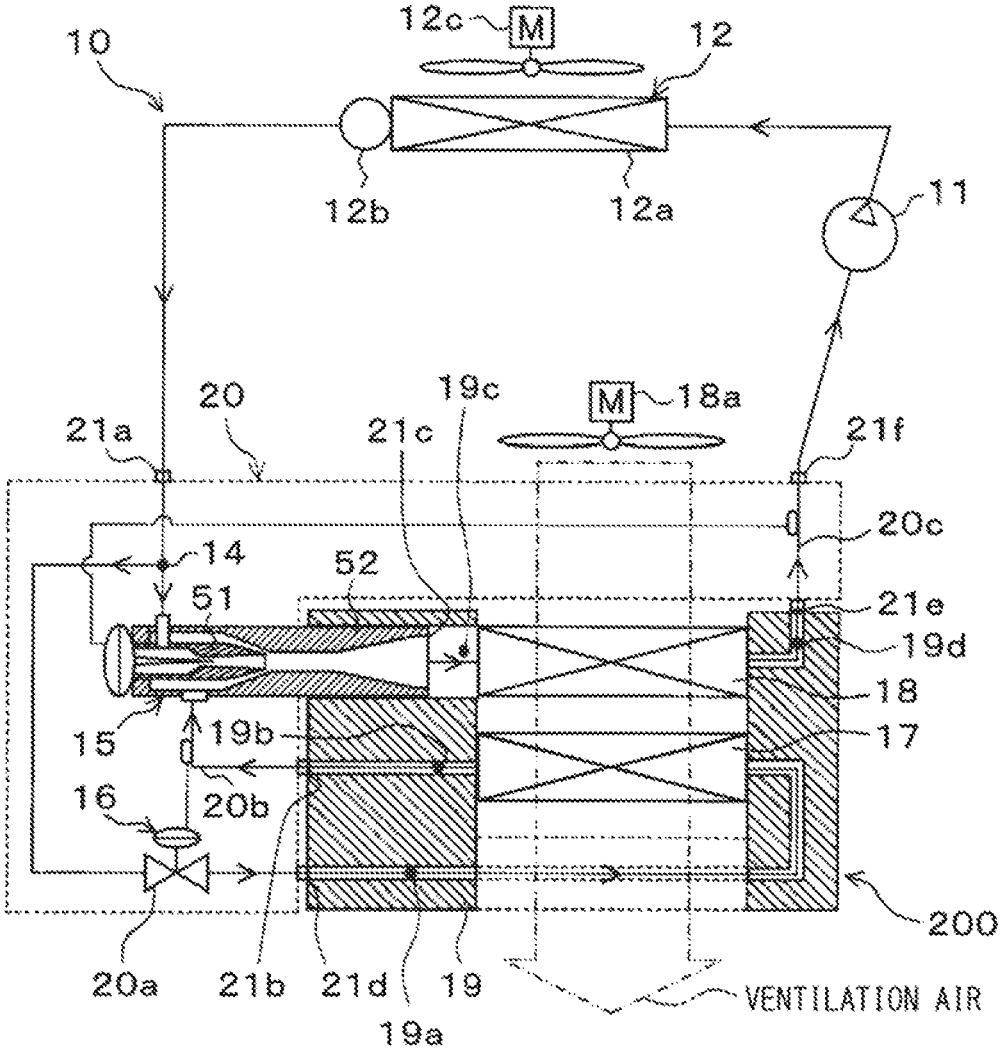
FIG. 1 is an entire schematic configuration diagram of an ejector refrigeration cycle of a first embodiment.

An evaporator unit used in an ejector refrigeration cycle may integrate (in other words, unitize or modularize) a branch portion, an ejector, a fixed throttle, a first evaporator, a second evaporator, and the like, among the components of the ejector refrigeration cycle.

In this case, the branch portion branches the flow of a high-pressure refrigerant flowing out of a radiator and then causes the branched streams to flow out to a fixed throttle side and a nozzle side of the ejector. The second evaporator is a heat exchanger that evaporates a refrigerant flowing out of a diffuser of the ejector by exchanging heat with the ventilation air to be blown into a space to be air-conditioned. The second evaporator causes the evaporated refrigerant to flow out to a suction-port side of the compressor. The first evaporator is a heat exchanger that evaporates the refrigerant decompressed in the fixed throttle, by exchanging heat with the ventilation air after passing through the second evaporator. The first evaporator causes the evaporated refrigerant to flow out to a refrigerant suction-port side of the ejector.

By integrating some of the cycle components as mentioned above, the evaporator unit can achieve a size reduction and an improvement in the productivity of the entire ejector refrigeration cycle that uses the evaporator unit.

However, the evaporator unit employs a fixed throttle and a fixed nozzle, as a nozzle of the ejector, which cannot change the passage cross-sectional area of its refrigerant passage. Thus, the energy conversion efficiency of the ejector may be reduced when the flow rate of the refrigerant flowing into the nozzle changes due to variations in the load on the ejector refrigeration cycle that uses the evaporator unit.

Therefore, if the load on the ejector refrigeration cycle varies, the ejector cannot exhibit a sufficient pressurizing effect, or otherwise an appropriate amount of refrigerant cannot be supplied to the evaporator due to the reduction in the suction effect of the ejector in some cases. Consequently, upon the occurrence of variations in the load on the ejector refrigeration cycle, the evaporator unit cannot sufficiently exhibit the above-mentioned effect of improving the COP.

In this regard, a variable throttle mechanism capable of changing the passage cross-sectional area (i.e., the throttle opening degree) may be employed in place of the fixed throttle, and that a variable nozzle capable of changing the passage cross-sectional area of its refrigerant passage may be employed as the nozzle of the ejector.

When the variable throttle mechanism is employed in place of the fixed throttle, a driving device is required to change the throttle opening degree. The same goes for the case of employing the variable nozzle as the nozzle of the ejector.

This kind of driving device has a relatively large body size. For this reason, a unit (or module) that integrates components, including an ejector with a variable throttle mechanism or variable nozzle, is more likely to increase in size. Consequently, the integrated unit may impair the size reduction effect of the entire ejector refrigeration cycle exhibited by integrating the components.

In view of the foregoing matter, the present disclosure is to provide an ejector module that is capable of changing its passage cross-sectional area without increasing the size of an ejector refrigeration cycle that uses the ejector module.

An ejector module according to a first aspect of the present disclosure is for use in an ejector refrigeration cycle that includes: a compressor configured to compress and discharge a refrigerant; a radiator configured to dissipate heat from the refrigerant discharged from the compressor; a first evaporator configured to evaporate the refrigerant; and a second evaporator configured to evaporate the refrigerant and to cause the refrigerant to flow out to a suction side of the compressor. The ejector module includes: a nozzle configured to decompress a part of the refrigerant flowing out of the radiator and to inject the decompressed refrigerant; a decompression portion configured to decompress another part of the refrigerant flowing out of the radiator; a body portion having a refrigerant suction port, through which the refrigerant is drawn from an outside by a suction effect of an injection refrigerant injected from the nozzle; a pressurizing portion configured to pressurize a mixed refrigerant of the injection refrigerant and a suction refrigerant drawn from the refrigerant suction port; a decompression-side valve body configured to change a passage cross-sectional area of the decompression portion; and a decompression-side driving portion configured to displace the decompression-side valve body.

Furthermore, a throttle-side outlet through which the refrigerant flows out of the decompression portion is connected to a refrigerant inlet side of the first evaporator, the refrigerant suction port is connected to a refrigerant outlet side of the first evaporator, and an ejector-side outlet through which the refrigerant flows out of the pressurizing portion is connected to a refrigerant inlet side of the second evaporator. In addition, the decompression-side driving portion and a central axis of the nozzle are disposed to overlap each other when viewed from a direction of a decompression-side central axis, in a case where the decompression-side central axis is defined as a central axis of the decompression-side driving portion in a displacement direction in which the decompression-side driving portion displaces the decompression-side valve body.

Because the ejector module includes the decompression portion, the decompression-side valve body, and the decompression-side driving portion, it can configure a variable throttle mechanism.

Therefore, the throttle opening degree of the variable throttle mechanism can be changed in accordance with variations in the load on the ejector refrigeration cycle that uses the ejector module. The flow rate of the refrigerant flowing into the variable throttle mechanism and the flow rate of the refrigerant flowing into the nozzle can also be appropriately adjusted in accordance with the load variation. Consequently, the ejector refrigeration cycle can exhibit the high COP, regardless of the load variation.

The ejector module also includes the nozzle, the body portion and the pressurizing portion, and thereby can configure the ejector. Thus, the ejector and the variable throttle mechanism can be integrated together.

In this case, the decompression-side driving portion and the central axis of the nozzle are disposed to overlap each other when viewed from the direction of the decompression-side central axis, thereby making it possible to suppress an increase in the size of the entire ejector module.

In more detail, with such an arrangement, the decompression-side driving portion, which has a relatively large body size, and the ejector, which is formed to extend in its axial direction, can be disposed to be shifted in the direction of the decompression-side central axis. Therefore, a portion configuring the main body of the variable throttle mechanism and a portion configuring the ejector can be brought close to each other. Consequently, an increase in the size of the entire ejector module can be suppressed.

Accordingly, this arrangement can provide the ejector module that is capable of changing the passage cross-sectional area, without increasing the size of the ejector refrigeration cycle that uses the ejector module. Specifically, because the decompression-side central axis and the central axis of the nozzle have a twisted positional relationship, the portion configuring the main body of the variable throttle mechanism and the portion configuring the ejector can be easily brought close to each other.

An ejector module according to a second aspect of the present disclosure includes: a nozzle configured to decompress a part of the refrigerant flowing out of the radiator and to inject the decompressed refrigerant; a decompression portion configured to decompress another part of the refrigerant flowing out of the radiator; a body portion that has a refrigerant suction port through which the refrigerant is drawn from an outside by a suction effect of an injection refrigerant injected from the nozzle; a pressurizing portion configured to pressurize a mixed refrigerant of the injection refrigerant and a suction refrigerant drawn from the refrigerant suction port; a nozzle-side valve body configured to change a passage cross-sectional area of the nozzle; a nozzle-side driving portion configured to displace the nozzle-side valve body; a decompression-side valve body configured to change a passage cross-sectional area of the decompression portion; and a decompression-side driving portion configured to displace the decompression-side valve body.

Furthermore, a throttle-side outlet through which the refrigerant flows out of the decompression portion is connected to a refrigerant inlet side of the first evaporator, the refrigerant suction port is connected to a refrigerant outlet side of the first evaporator, and an ejector-side outlet through which the refrigerant flows out of the pressurizing portion is connected to a refrigerant inlet side of the second evaporator. If a nozzle-side central axis is defined as a central axis of the nozzle-side driving portion in a displacement direction in which the nozzle-side driving portion displaces the nozzle-side valve body, and if a decompression-side central axis is defined as a central axis of the decompression-side driving portion in a displacement direction in which the decompression-side driving portion displaces the decompression-side valve body, the driving portion (i.e., the driving portion which makes the valve body to be displaced in the one central axis) corresponding to the one central axis of the nozzle-side central axis and the decompression-side central axis is disposed to overlap with the other central axis of the nozzle-side central axis and the decompression-side central axis, when being viewed from the one central axis.

Because the above-mentioned ejector module includes the decompression portion, the decompression-side valve body, and the decompression-side driving portion, it can configure the variable throttle mechanism. The ejector module also includes the nozzle, the nozzle-side valve portion, and the nozzle-side driving portion, and thereby it is possible to configure a variable nozzle.

Therefore, the throttle opening degree of the variable throttle mechanism and the passage cross-sectional area of the nozzle can be changed in accordance with variations in the load on the ejector refrigeration cycle that uses the ejector module. The flow rate of the refrigerant flowing into the variable throttle mechanism and the flow rate of the refrigerant flowing into the nozzle can also be appropriately adjusted in accordance with the load variation. Consequently, the ejector refrigeration cycle can exhibit the high COP, regardless of the load variation.

Because the ejector module includes the nozzle, the nozzle-side valve body, the nozzle-side driving portion, the body portion, and the pressurizing portion, it can configure the ejector including the variable nozzle. Thus, the ejector and the variable throttle mechanism can be integrated together.

In this case, when viewed from the central axis direction of one of the nozzle-side central axis and the decompression-side central axis, the driving portion corresponding to the one central axis and the other central axis are disposed to overlap each other, thus making it possible to suppress an increase in the size of the entire ejector module.

In more detail, with such an arrangement, the decompression-side driving portion, which has a relatively large body size, and the nozzle-side driving portion can be disposed to be shifted in the direction of either the central axis. Therefore, the portion configuring the main body of the variable throttle mechanism and the portion configuring the main body of the ejector can be brought close to each other. Consequently, an increase in the size of the entire ejector module can be suppressed.

That is, because the nozzle-side central axis and the decompression-side central axis have a twisted positional relationship, the portion configuring the main body of the variable throttle mechanism and the portion configuring the main body of the ejector can be easily brought close to each other.

Hereinafter, embodiments of the present disclosure will be described with reference to the drawings. In the respective embodiments below, the same or equivalent parts will be denoted by the same reference characters.

First Embodiment

A first embodiment of the present disclosure will be described below with reference to FIGS. 1 to 5. As shown in the entire configuration diagram of FIG. 1, an ejector module 20 of the present embodiment is used in an ejector refrigeration cycle 10, which is a vapor compression refrigeration cycle device that includes an ejector as a refrigerant decompression device. The ejector refrigeration cycle 10 is used in a vehicle air conditioner and serves to cool the ventilation air to be blown into the interior of a vehicle cabin as a space to be cooled. Therefore, a fluid to be cooled in the ejector refrigeration cycle 10 is the ventilation air.

The ejector refrigeration cycle 10 forms a subcritical refrigeration cycle in which a high-pressure side refrigerant pressure of the cycle does not exceed the critical pressure of the refrigerant, using a hydrofluorocarbon (HFC)-based refrigerant (for example, R134a) as the refrigerant. Refrigerant oil for lubricating the compressor 11 is mixed in the refrigerant. Part of the refrigerant oil circulates in the cycle together with the refrigerant.

Among the components of the ejector refrigeration cycle 10, a compressor 11 draws and compresses the refrigerant into a high-pressure refrigerant and then discharges the compressed high-pressure refrigerant. More specifically, the compressor 11 of the present embodiment is an electric compressor that accommodates a fixed displacement compression mechanism and an electric motor for driving the compression mechanism, in a housing.

As the compression mechanism, various types of compression mechanisms, such as a scroll compression mechanism and a vane compression mechanism, can be employed. The electric motor has its operation (rotation speed) controlled by a control signal output from an air-conditioning controller (not shown). The electric motor may employ either an AC motor or a DC motor.

A discharge port of the compressor 11 is connected to a refrigerant inlet side of a condensing portion 12*a* of a radiator 12. The radiator 12 is a heat-dissipation heat exchanger that exchanges heat between a high-pressure side refrigerant discharged from the compressor 11 and the air outside the vehicle cabin (outside air) blown from a cooling fan 12*c* to dissipate the heat from the high-pressure refrigerant, thereby cooling the refrigerant.

More specifically, the radiator 12 is configured as the so-called receiver-integrated condenser, which has the condensing portion 12*a* and a receiver 12*b*. The condensing portion 12*a* is a condensation heat exchanging portion that exchanges heat between the high-pressure gas-phase refrigerant discharged from the compressor 11 and the outside air blown from the cooling fan 12*c* to dissipate the heat from the high-pressure gas-phase refrigerant, thereby condensing the refrigerant. The receiver 12*b* is a refrigerant casing that stores an excess liquid-phase refrigerant which is produced by separating the refrigerant flowing out of the condensing portion 12*a* into the gas-phase refrigerant and the liquid-phase refrigerant.

The cooling fan 12*c* is an electric blower that has its rotation speed (blowing air amount) controlled by a control voltage output from the air-conditioning controller.

A refrigerant outlet of the receiver 12*b* of the radiator 12 is connected to the side of a high-pressure inlet 21*a* provided in a body portion 21 of the ejector module 20. The ejector module 20 is formed by integrating (in other words, modularizing) the cycle components enclosed by the broken line in FIG. 1. More specifically, the ejector module 20 integrates a branch portion 14, an ejector 15, a variable throttle mechanism 16, and the like.

The branch portion 14 serves to branch the flow of the refrigerant flowing out of the radiator 12, causing one of the branched refrigerants to flow out to the nozzle 51 side of the ejector 15 and also causing the other branched refrigerant to flow out to the inlet side of the variable throttle mechanism 16. The branch portion 14 is formed by connecting a plurality of refrigerant passages formed inside the body portion 21 of the ejector module 20.

The ejector 15 has a nozzle 51 that decompresses and injects one of the refrigerants branched by the branch portion 14 and serves as a refrigerant decompression device. The ejector 15 functions as a refrigerant circulation device that draws and circulates the refrigerant from the outside by a suction effect of the injection refrigerant injected from the nozzle 51. More specifically, the ejector 15 draws the refrigerant flowing out of a first evaporator 17 to be described later.

In addition, the ejector 15 functions as an energy conversion device that converts the kinetic energy of a mixed refrigerant of the injection refrigerant injected from the nozzle 51 and the suction refrigerant drawn from a refrigerant suction port 21*b* formed in the body portion 21, into the pressure energy, thereby pressurizing the mixed refrigerant. The ejector 15 causes the pressurized refrigerant to flow out to the refrigerant inlet side of a second evaporator 18 to be described later. The nozzle 51 of the ejector 15 is configured to be capable of changing the passage cross-sectional area of the nozzle.

The variable throttle mechanism 16 has a throttle passage 20*a* for decompressing the other refrigerant branched by the branch portion 14. The variable throttle mechanism 16 is configured to be capable of changing the passage cross-sectional area (i.e., throttle opening degree) of the throttle passage 20*a*. The variable throttle mechanism 16 causes the decompressed refrigerant to flow out to the refrigerant inlet side of the first evaporator 17.

Figure 3:
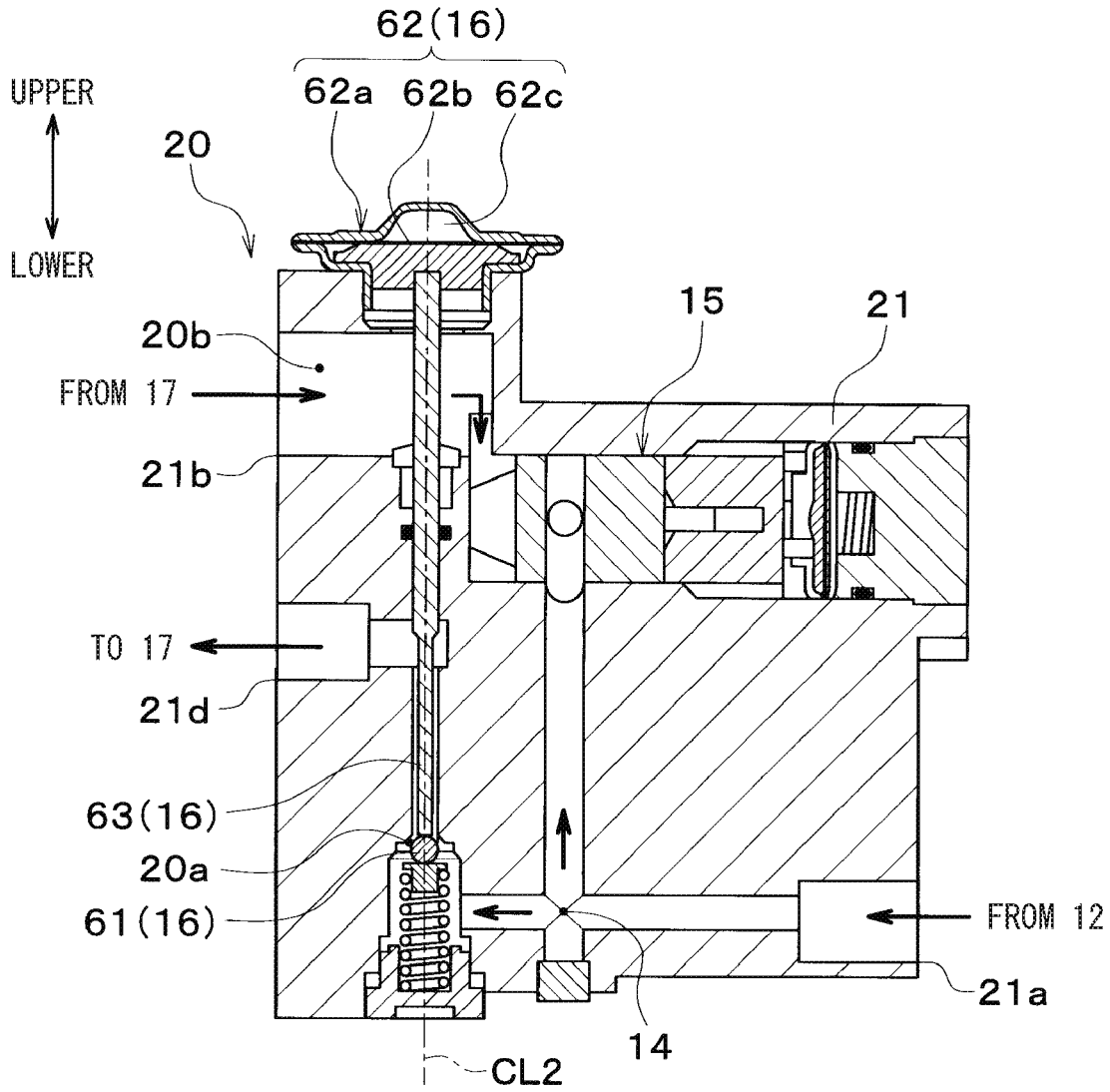
FIG. 3 is an axial cross-sectional view including a decompression-side central axis of the ejector module of the first embodiment.
Figure 4:
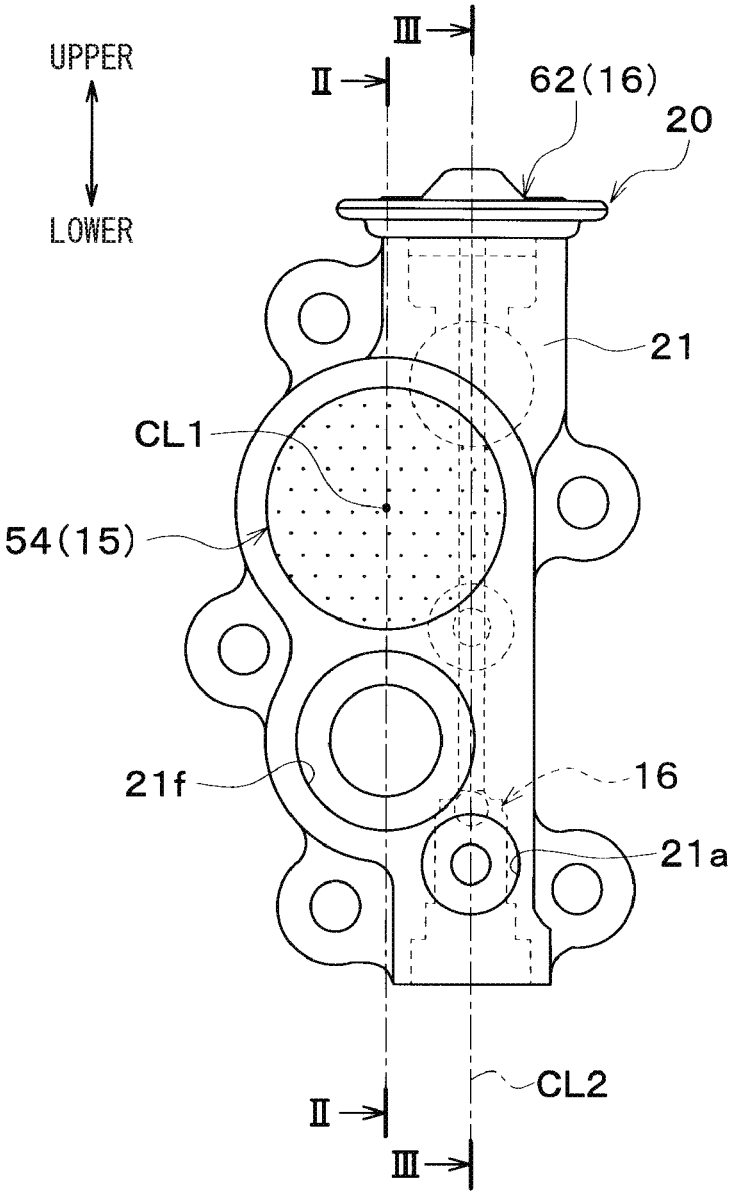
FIG. 4 is a side view of the ejector module of the first embodiment.
Figure 5:
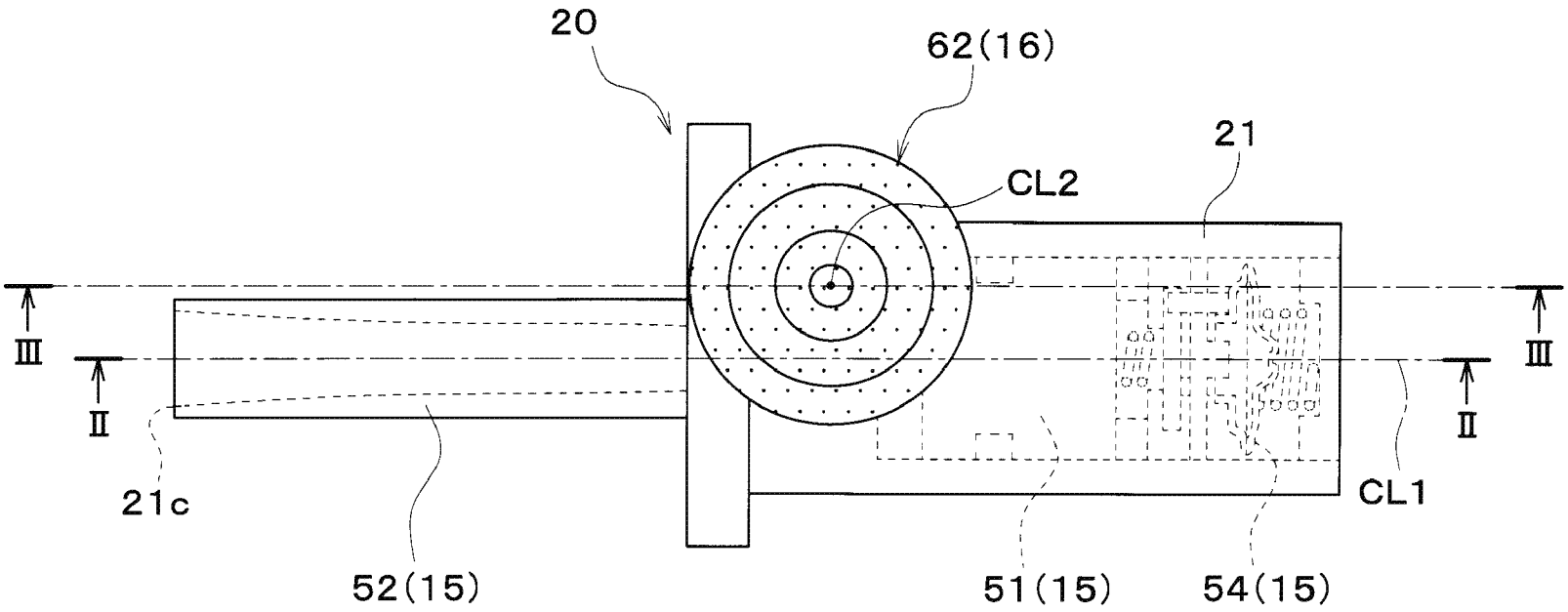
FIG. 5 is a top view of the ejector module of the first embodiment.

Now, the detailed configuration of the ejector module 20 will be described with reference to FIGS. 2 to 5 in addition to FIG. 1. The respective up and down arrows in FIGS. 2 to 4 indicate the upward and downward directions in a state where the ejector refrigeration cycle 10 is mounted on a vehicle air conditioner. The same goes for the following drawings. FIG. 2 is a cross-sectional view taken along the line II-II shown in FIGS. 4 and 5, while FIG. 3 is a cross-sectional view taken along the line III-III in FIGS. 4 and 5. FIG. 4 is a view in the direction of arrow IV in FIG. 2. FIG. 5 is a view in the direction of arrow V in FIG. 2.

Figure 2:
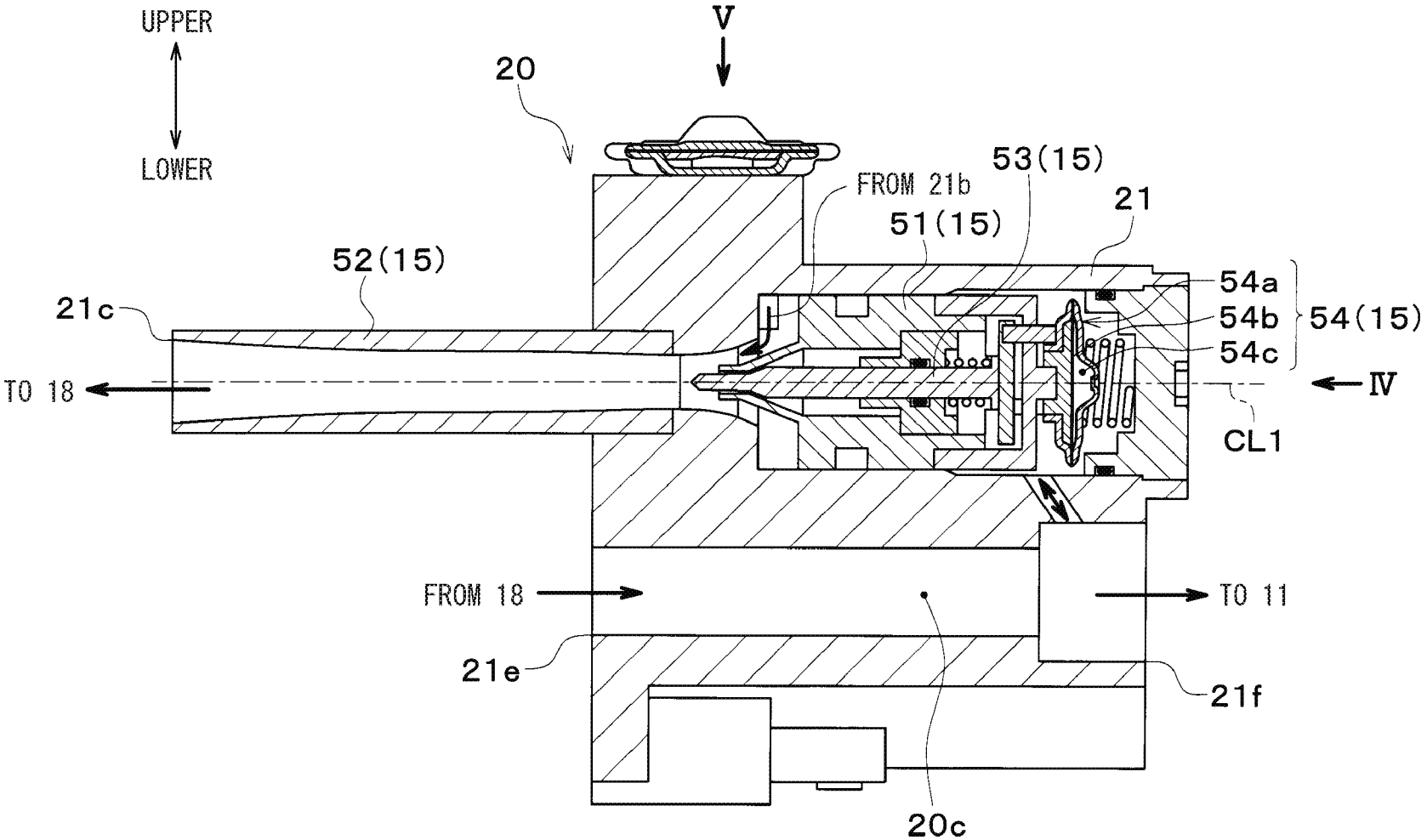
FIG. 2 is an axial cross-sectional view including a nozzle-side central axis of an ejector module of the first embodiment.

For simplification of the illustration and clarification of the description, the flow direction of the refrigerant in the ejector 15 shown in the entire configuration diagram of FIG. 1 is set different from the flow direction of the refrigerant in the ejector 15 shown in FIGS. 2 and 5 and the like.

The body portion 21 is formed by combining a plurality of constituent members made of metal (aluminum, in the present embodiment). The body portion 21 forms an outer shell of the ejector module 20, and functions as a housing that accommodates therein the constituent members, such as the ejector 15 and the variable throttle mechanism 16. The body portion 21 may be formed of resin.

Various types of refrigerant passages 20*a* to 20*c* are formed inside the body portion 21. The body portion 21 is provided with a plurality of refrigerant inlets/outlets, including the high-pressure inlet 21*a*, the refrigerant suction port 21*b*, a throttle-side outlet 21*d*, a low-pressure inlet 21*e*, and a low-pressure outlet 21*f*. An ejector-side outlet 21*c* is provided in a portion, on the most downstream side of the refrigerant flow, of a diffuser 52 of the ejector 15, which will be described later, with the diffuser 52 fixed to the body portion 21.

As shown in FIG. 3, the high-pressure inlet 21*a* is a refrigerant inlet through which the refrigerant flowing out of the refrigerant outlet of the receiver 12*b* in the radiator 12 flows into the ejector module 20. Therefore, the high-pressure inlet 21*a* is a refrigerant inlet for the branch portion 14.

As shown in FIG. 3, the refrigerant suction port 21*b* is a refrigerant inlet into which the refrigerant flowing out of the first evaporator 17 is drawn. The suction refrigerant drawn from the refrigerant suction port 21*b* is merged with the injection refrigerant injected from the nozzle 51. Therefore, a suction side passage 20*b* is a refrigerant passage where the suction refrigerant drawn from the refrigerant suction port 21*b* is circulated and merged with the injection refrigerant.

The ejector-side outlet 21*c* is a refrigerant outlet from which the refrigerant pressurized by the diffuser 52 flows out to the inlet side of the second evaporator 18. As shown in FIG. 3, the throttle-side outlet 21*d* is a refrigerant outlet through which the refrigerant decompressed by the variable throttle mechanism 16 flows out to the inlet side of the first evaporator 17.

As shown in FIG. 2, the low-pressure inlet 21*e* is a refrigerant inlet into which the refrigerant flowing out of the second evaporator 18 flows. In addition, as shown in FIG. 2, the low-pressure outlet 21*f* is a refrigerant outlet through which the refrigerant flowing into the low-pressure inlet 21*e* flows out to the suction port side of the compressor 11. Therefore, the refrigerant passage leading from the low-pressure inlet 21*e* to the low-pressure outlet 21*f* is an outflow side passage 20*c*.

As shown in FIGS. 2 to 4, the high-pressure inlet 21*a* and the low-pressure outlet 21*f* are opened on the same plane in the same direction. The ejector-side outlet 21*c*, the low-pressure inlet 21*e*, the refrigerant suction port 21*b*, and the throttle-side outlet 21*d* are opened in the same direction. The low-pressure inlet 21*e*, the refrigerant suction port 21*b*, and the throttle-side outlet 21*d* are opened on the same plane. The expression "refrigerant inlet and outlet are opened in the same direction" as used herein means that the inflow and outflow directions of the refrigerant coincide with each other.

As shown in FIGS. 2 and 3, the ejector 15 includes the nozzle 51, the refrigerant suction port 21*b* and the suction side passage 20*b* which are formed in the body portion 21, the diffuser 52, a needle valve 53, a nozzle-side driving mechanism 54, and the like.

The nozzle 51 isentropically decompresses and injects the refrigerant in a refrigerant passage formed therein. As shown in FIG. 2, the nozzle 51 is formed of a substantially cylindrical metal (a stainless steel alloy or brass in the present embodiment) that tapers toward the flow direction of the refrigerant. The nozzle 51 is fixed to the body portion 21 by any suitable means, such as press-fitting.

The refrigerant passage formed inside the nozzle 51 is provided with a throat portion and a diverging portion. The throat portion has the refrigerant passage area converged most. The diverging portion has the refrigerant passage area gradually expanding from the throat portion toward a refrigerant injection port through which the refrigerant is injected. That is, the nozzle 51 is constituted of a de Laval nozzle.

The nozzle 51 employed in the present embodiment is designed such that the flow speed of the injection refrigerant injected from the refrigerant injection port is equal to or higher than the sonic speed during a normal operation of the ejector refrigeration cycle 10. It is apparent that the nozzle 51 may be formed by a tapered nozzle.

The cylindrical side surface of the nozzle 51 defines an inlet hole through which one of the refrigerants branched by the branch portion 14 flows into the refrigerant passage of the nozzle. The above-mentioned suction side passage 20*b* is formed to guide the suction refrigerant into a space on an outer peripheral side of the nozzle 51 and to communicate the refrigerant suction port 21*b* with the refrigerant injection port of the nozzle 51.

The diffuser 52 is a pressurizing portion that pressurizes the mixed refrigerant. The diffuser 52 is formed of a cylindrical metal (aluminum in the present embodiment). The diffuser 52 of the present embodiment is fixed to the body portion 21 by any suitable means, such as press-fitting. It is apparent that the diffuser 52 may be integrally formed of the same member as the body portion 21.

The refrigerant passage formed inside the diffuser 52 is formed in a substantially frusto-conical shape that gradually enlarges its passage cross-sectional area toward the downstream side of the refrigerant flow. The diffuser 52 with such a passage shape converts the kinetic energy of the mixed refrigerant circulating through the diffuser 52 into the pressure energy.

The diffuser 52 protrudes from the body portion 21 toward the downstream side of the refrigerant flow. Thus, as shown in FIGS. 2 and 3, the ejector-side outlet 21*c* formed in the portion, on the most downstream side of the refrigerant flow, of the diffuser 52 is opened on a plane different from the planes where the refrigerant suction port 21*b*, the throttle-side outlet 21*d*, and the low-pressure inlet 21*e* are opened.

The needle valve 53 is a nozzle-side valve body that changes the passage cross-sectional area of the refrigerant passage formed inside the nozzle 51.

The needle valve 53 is formed in a needle shape (or a shape formed by combining a conical shape, a cylindrical shape, and the like). The central axis of the needle valve 53 is arranged coaxially with the central axis of the nozzle 51 and the central axis of the refrigerant passage of the diffuser 52. The needle valve 53 is displaced in the direction of its central axis to change the passage cross-sectional area of the refrigerant passage in the nozzle 51. The needle valve 53 can also abut against the throat portion of the nozzle 51 to close the nozzle 51.

The nozzle-side driving mechanism 54 is a nozzle-side driving portion that displaces the needle valve 53 in the central axis direction of the nozzle 51. The nozzle-side driving mechanism 54 is constituted of a mechanical mechanism.

More specifically, the nozzle-side driving mechanism 54 includes a nozzle-side thermo-sensitive portion 54*a* having a nozzle-side deformation member (specifically, a nozzle-side diaphragm 54*b*) that is deformed depending on the temperature and pressure of the refrigerant flowing out of the second evaporator 18. Then, the deformation of the diaphragm 54*b* is transferred to the needle valve 53, thereby displacing the needle valve 53.

The nozzle-side diaphragm 54*b* has an enclosed space 54*c* formed to enclose therein a thermo-sensitive medium, the pressure of which changes together with changes in the temperature of the nozzle-side thermo-sensitive portion 54*a*. The present embodiment employs, as the thermo-sensitive medium, a medium that contains the refrigerant circulating in the ejector refrigeration cycle 10 as a main component.

The nozzle-side thermo-sensitive portion 54*a* is disposed in a space formed in the body portion 21 and communicating with the outflow side passage 20*c*. Thus, the pressure of the thermo-sensitive medium in the enclosed space 54*c* changes depending on the temperature of the low-pressure refrigerant circulating in the outflow side passage 20*c* (i.e., the refrigerant flowing out of the second evaporator 18). The diaphragm 54*b* is deformed depending on a difference between the pressure of the low-pressure refrigerant circulating in the outflow side passage 20*c* and the pressure of the thermo-sensitive medium in the enclosed space 54*c*.

Therefore, the diaphragm 54*b* is desirably formed of material with rich elasticity and excellent pressure resistance and airtightness. Thus, in the present embodiment, a circular metallic thin plate made of stainless (SUS304) is employed as the diaphragm 54*b*.

In the nozzle-side driving mechanism 54 of the present embodiment, a part of the diaphragm 54*b* is fixed to the body portion 21, and the needle valve 53 is fixed to a case forming the enclosed space 54*c*, together with the diaphragm 54*b*.

Therefore, when the temperature (superheat degree) of the low-pressure refrigerant circulating through the outflow side passage 20*c* increases, the saturated pressure of the thermo-sensitive medium in the enclosed space 54*c* increases, resulting in an increased pressure difference obtained by subtracting the pressure of the low-pressure refrigerant circulating through the outflow side passage 20*c* from the pressure of the thermo-sensitive medium in the enclosed space 54*c*. Thus, the diaphragm 54*b* is deformed toward the side where the enclosed space 54*c* expands. Consequently, the needle valve 53 is displaced toward the side where the passage cross-sectional area of the nozzle 51 is enlarged (i.e., the side away from the throat portion).

When the temperature (superheat degree) of the low-pressure refrigerant circulating through the outflow side passage 20*c* decreases, the saturated pressure of the thermo-sensitive medium in the enclosed space 54*c* reduces, resulting in a decreased pressure difference obtained by subtracting the pressure of the low-pressure refrigerant circulating through the outflow side passage 20*c* from the pressure of the thermo-sensitive medium in the enclosed space 54*c*. Thus, the diaphragm 54*b* is deformed toward the side where the enclosed space 54*c* is contracted. Consequently, the needle valve 53 is displaced toward the side where the passage cross-sectional area of the nozzle 51 is contracted (i.e., the side closer to the throat portion).

That is, the nozzle-side driving mechanism 54 can displace the needle valve 53 in accordance with the superheat degree of the refrigerant flowing out of the second evaporator 18. Thus, the nozzle-side driving mechanism 54 of the present embodiment displaces the needle valve 53 such that the superheat degree of the refrigerant located on the outlet side of the second evaporator 18 approaches a predetermined nozzle-side reference superheat degree (specifically, 1° C.).

The nozzle-side driving mechanism 54 has a coil spring as an elastic member that applies a load on the nozzle-side thermo-sensitive portion 54*a* toward the side where the needle valve 53 contracts the passage cross-sectional area of the nozzle 51. The nozzle-side reference superheat degree can be adjusted by changing the load of the coil spring.

Here, when a nozzle-side central axis CL1 is defined as the central axis of the nozzle-side driving mechanism 54 in the displacement direction in which the nozzle-side driving mechanism 54 displaces the needle valve 53, the nozzle-side central axis CL1 coincides with each of the central axis of the nozzle 51, the central axis of the needle valve 53, and the central axis of the diffuser 52.

As shown in FIG. 3, the variable throttle mechanism 16 includes the throttle passage 20*a*, a throttle valve 61, a decompression-side driving mechanism 62, and the like.

The throttle passage 20*a* is a decompression portion that decompresses the other refrigerant branched in the branch portion 14 by contracting its passage cross-sectional area. The throttle passage 20*a* is formed in a rotary body shape, such as a cylindrical shape or a frusto-conical shape. The decompression portion of the present embodiment is formed integrally with the body portion 21. It is apparent that an orifice formed by a member which is separate from the body portion 21 may be employed as the decompression portion, and the orifice may be fixed to the body portion 21 by any suitable means, such as pressure-fitting.

The throttle valve 61 is formed in a spherical shape. The throttle valve 61 is a decompression-side valve body that changes the passage cross-sectional area (i.e., throttle opening degree) of the throttle passage 20*a* by being displaced in the direction of the central axis of the throttle passage 20*a*. The throttle passage 20*a* can also be closed by abutting the throttle valve 61 against the outlet of the throttle passage 20*a*.

The decompression-side driving mechanism 62 is a decompression-side driving portion that displaces the throttle valve 61 in the central axis direction of the throttle passage 20*a*. The decompression-side driving mechanism 62 is constituted of a mechanical mechanism similar to the nozzle-side driving mechanism 54.

More specifically, the decompression-side driving mechanism 62 includes a decompression-side thermo-sensitive portion 62*a* having a decompression-side deformation member (specifically, a decompression-side diaphragm 62*b*) that is deformed depending on the temperature and pressure of the refrigerant flowing out of the first evaporator 17. Then, the deformation of the diaphragm 62*b* is transferred to the throttle valve 61, thereby displacing the throttle valve 61.

In the decompression-side driving mechanism 62, a part of the decompression-side thermo-sensitive portion 62*a* is disposed in the suction side passage 20*b*. Further, in the decompression-side driving mechanism 62 of the present embodiment, the displacement of the diaphragm 62*b* is transmitted to the throttle valve 61 via an operation rod 63. The operation rod 63 is formed in a columnar shape that extends in the displacement direction of the throttle valve 61.

When the temperature (superheat degree) of the low-pressure refrigerant circulating through the suction side passage 20*b* increases, the saturated pressure of the thermo-sensitive medium in an enclosed space 62*c* of the decompression-side driving mechanism 62 increases, resulting in an increased pressure difference obtained by subtracting the pressure of the low-pressure refrigerant circulating through the suction side passage 20*b* from the pressure of the thermo-sensitive medium in the enclosed space 62*c*. Thus, once the diaphragm 62*b* is deformed, the throttle valve 61 is displaced toward the side where the throttle opening degree of the throttle passage 20*a* is enlarged.

When the temperature (superheat degree) of the low-pressure refrigerant circulating through the suction side passage 20*b* decreases, the saturated pressure of the thermo-sensitive medium in the enclosed space 62*c* reduces, resulting in a decreased pressure difference obtained by subtracting the pressure of the low-pressure refrigerant circulating through the suction side passage 20*b* from the pressure of the thermo-sensitive medium in the enclosed space 62*c*. Thus, once the diaphragm 62*b* is deformed, the throttle valve 61 is displaced toward the side where the throttle opening degree of the throttle passage 20*a* is contracted.

That is, the decompression-side driving mechanism 62 can displace the throttle valve 61 in accordance with the superheat degree of the refrigerant flowing out of the first evaporator 17. Thus, the nozzle-side driving mechanism 54 of the present embodiment displaces the throttle valve 61 such that the superheat degree of the refrigerant located on the outlet side of the first evaporator 17 approaches a predetermined decompression-side reference superheat degree (specifically, 0° C.). That is, the nozzle-side driving mechanism 54 of the present embodiment displaces the throttle valve 61 such that the refrigerant located on the outlet side of the first evaporator 17 becomes a saturated gas-phase refrigerant.

The decompression-side reference superheat degree can also be adjusted by changing the load of the coil spring, which is an elastic member for applying the load on the throttle valve 61, in the same way as the nozzle-side reference superheat degree.

Here, when a decompression-side central axis CL2 is defined as the central axis of the decompression-side driving mechanism 62 in the displacement direction in which the decompression-side driving mechanism 62 displaces the throttle valve 61, the decompression-side central axis CL2 coincides with each of the central axis of the throttle passage 20*a* and the central axis of the operation rod 63.

In the ejector module 20 of the present embodiment, the nozzle-side central axis CL1 and the decompression-side central axis CL2 have a twisted positional relationship, and the driving portion corresponding to one central axis and the other central axis are disposed to overlap each other when viewed from the central axis direction of one of the nozzle-side central axis CL1 and the decompression-side central axis CL2.

For example, as shown in FIG. 4, the nozzle-side driving mechanism 54 occupying a region indicated by hatching with points in FIG. 4 and the decompression-side central axis CL2 are disposed to overlap each other when viewed from the direction of the nozzle-side central axis CL1. As shown in FIG. 5, the decompression-side driving mechanism 62 occupying a region indicated by hatching with points in FIG. 5 and the nozzle-side central axis CL1 are disposed to overlap each other when viewed from the direction of the decompression-side central axis CL2.

The term "twisted positional relationship" as used herein means the positional relationship in which two straight lines are disposed not to be parallel and not to intersect with each other. In the present embodiment, an angle formed between the nozzle-side central axis CL1 and the decompression-side central axis CL2, i.e., an angle formed by the vector of the nozzle-side central axis CL1 and the vector of the decompression side central axis CL2 is 90°.

The second evaporator 18 shown in FIG. 1 is a heat-absorption heat exchanger that exchanges heat between the ventilation air blown from a blower 18*a* toward the interior of the vehicle cabin and the low-pressure refrigerant flowing out of the ejector-side outlet 21*c* of the ejector module 20 (i.e., a refrigerant outlet of the diffuser 52 in the ejector 15), thereby evaporating the low-pressure refrigerant to exhibit the heat absorption effect, so that the ventilation air is cooled.

The blower 18*a* is an electric blower that has its rotation speed (blowing air amount) controlled by a control voltage output from the air-conditioning controller. A refrigerant outlet of the second evaporator 18 is connected to the side of the low-pressure inlet 21*e* of the ejector module 20.

The first evaporator 17 is a heat-absorption heat exchanger that exchanges heat between the ventilation air passing through the second evaporator 18 and the low-pressure refrigerant flowing out of the throttle-side outlet 21*d* (i.e., a refrigerant outlet of the variable throttle mechanism 16) of the ejector module 20, thereby evaporating the low-pressure refrigerant to exhibit the heat absorption effect, so that the ventilation air is cooled. A refrigerant outlet of the first evaporator 17 is connected to the refrigerant suction port 21*b* side of the ejector module 20.

The first evaporator 17 and the second evaporator 18 of the present embodiment are integrated together. Specifically, each of the first evaporator 17 and the second evaporator 18 is configured as the so-called tank and tube type heat exchanger that includes a plurality of tubes through which the refrigerant circulates, and a pair of collection-distribution tanks disposed on both ends of the plurality of tubes to collect or distribute the refrigerants circulating through the tubes.

The first evaporator 17 and the second evaporator 18 are integrated together by forming the collection-distribution tanks of the first evaporator 17 and the second evaporator 18 using the same member. At this time, in the present embodiment, the first evaporator 17 and the second evaporator 18 are disposed in series with respect to the ventilation air flow such that the second evaporator 18 is disposed on the upstream side of the ventilation air flow with respect to the first evaporator 17. Thus, the ventilation air flows as indicated by the arrows drawn by the two-dot chain lines in FIG. 1.

In the present embodiment, a dedicated collection pipe 19 is used to connect between the first evaporator 17 and the second evaporator 18 which are integrated with respective refrigerant inlets/outlets 21*b* to 21*e* in the ejector module 20. The first evaporator and the second evaporator are integrated with the refrigerant inlets/outlets by joining means, such as brazing of a plurality of metal refrigerant pipes or plate members included in the collection pipe 19. The collection pipe 19 includes first to fourth connection passages 19*a* to 19*d*.

The first connection passage 19*a* is a refrigerant passage that connects the throttle-side outlet 21*d* of the ejector module 20 with the refrigerant inlet of the first evaporator 17. The second connection passage 19*b* is a refrigerant passage that connects the refrigerant outlet of the first evaporator 17 with the refrigerant suction port 21*b*. The third connection passage 19*c* is a refrigerant passage that connects the ejector-side outlet 21*c* with the refrigerant inlet of the second evaporator 18. The fourth connection passage 19*d* is a refrigerant passage that connects the refrigerant outlet of the second evaporator 18 with the low-pressure inlet 21*e*.

As shown in FIG. 1, in the present embodiment, a part of the diffuser 52 that protrudes from the body portion 21 is accommodated in the third connection passage 19*c*. In other words, the diffuser 52 is formed so as to be accommodated in the collection pipe 19 by protruding from the body portion 21.

Thus, the ejector module 20 is integrated with the first evaporator 17 and the second evaporator 18 via the collection pipe 19. That is, in the present embodiment, the ejector module 20, the collection pipe 19, the first evaporator 17, and the second evaporator 18 are integrated together as an evaporator unit 200.

Next, an electric control unit of the ejector refrigeration cycle 10 in the present embodiment will be described. The air-conditioning controller (not shown) is constituted of a known microcomputer, including a CPU, a ROM, and a RAM, and peripheral circuits thereof. The air-conditioning controller performs various computations and processing based on a control program stored in the ROM to thereby control the operations of various control target devices 11, 12*c*, and 18*a* and the like that are connected to its output side.

A group of sensors is connected to the air-conditioning controller. Detection values from these air-conditioning sensors are input to the air-conditioning controller. The group of sensors includes an inside-air temperature sensor, an outside-air temperature sensor, a solar radiation sensor, an evaporator temperature sensor, and the like. The inside-air temperature sensor detects the temperature of the interior of the vehicle cabin. The outside-air temperature sensor detects an outside air temperature. The solar radiation sensor detects the amount of solar radiation in the vehicle cabin. The evaporator temperature sensor detects the temperature of air blown from the first evaporator 17 (evaporator temperature).

The input side of the air-conditioning controller is connected to an operation panel (not shown). Operation signals from various operation switches provided on the operation panel are input to the air-conditioning controller. Various operation switches provided on the operation panel include an air-conditioning operation switch for requesting air-conditioning, a vehicle-interior temperature setting switch for setting the temperature of the interior of the vehicle cabin, and the like.

The air-conditioning controller of the present embodiment incorporates therein a control unit for controlling the operation of each of various control target devices connected to its output side. In the air-conditioning controller, a configuration (hardware and software) for controlling the operation of each control target device serves as the control unit for controlling the control target device. For example, in the present embodiment, the configuration for controlling the operation of the compressor 11 serves as a discharge capacity control unit.

Now, the operation of the ejector refrigeration cycle 10 with the above-mentioned configuration in the present embodiment will be described. When an air-conditioning operation switch on the operation panel is turned on (in the ON state), the air-conditioning controller actuates the compressor 11, the cooling fan 12*c*, the blower 18*a*, and the like.

In this way, the compressor 11 draws, compresses, and discharges the refrigerant. The high-temperature and high-pressure refrigerant discharged from the compressor 11 flows into the radiator 12. The refrigerant flowing into the radiator 12 is condensed by exchanging heat with the outside air blown from the cooling fan 12*c* in the condensing portion 12*a*. The refrigerant cooled in the condensing portion 12*a* is separated into a gas-phase refrigerant and a liquid-phase refrigerant by the receiver 12*b*.

The liquid-phase refrigerant separated by the receiver 12*b* flows into the high-pressure inlet 21*a* of the ejector module 20. The refrigerant flowing into the ejector module 20 is branched by the branch portion 14. One of the branched refrigerants flows into the nozzle 51 of the ejector 15 and is isentropically decompressed and injected. The refrigerant flowing out of the first evaporator 17 is drawn from the refrigerant suction port 21*b* by the suction effect of the injection refrigerant.

At this time, the nozzle-side driving mechanism 54 displaces the needle valve 53 such that the superheat degree of the refrigerant circulating through the outflow side passage 20*c* (in other words, the refrigerant located on the outlet side of the second evaporator 18) approaches the nozzle-side reference superheat degree (specifically, 1° C.).

The injection refrigerant injected from the nozzle 51 and the suction refrigerant drawn from the refrigerant suction port 21*b* flow into the diffuser 52 of the ejector 15. The diffuser 52 converts the speed energy of the refrigerant into the pressure energy thereof by enlarging the refrigerant passage area of the diffuser. Thus, the pressure of the mixed refrigerant of the injection refrigerant and the suction refrigerant increases. The refrigerant pressurized in the diffuser 52 flows out of the ejector-side outlet 21*c*.

The refrigerant flowing out of the ejector-side outlet 21*c* flows into the second evaporator 18 via the third connection passage 19*c* of the collection pipe 19. The refrigerant flowing into the second evaporator 18 absorbs heat from the ventilation air blown by the blower 18*a* to evaporate. Thus, the ventilation air blown by the blower 18*a* is cooled.

The refrigerant flowing out of the second evaporator 18 is drawn into and compressed again by the compressor 11 via the fourth connection passage 19*d* of the collection pipe 19 and the outflow side passage 20*c* of the ejector module 20.

The other refrigerant branched by the branch portion 14 flows into the throttle passage 20*a* of the variable throttle mechanism 16 and is isentropically decompressed therein. At this time, the decompression-side driving mechanism 62 displaces the throttle valve 61 such that the superheat degree of the refrigerant circulating through the suction side passage 20*b* (in other words, the refrigerant located on the outlet side of the first evaporator 17) approaches the decompression-side reference superheat degree (specifically, 0° C.). The refrigerant decompressed by the variable throttle mechanism 16 flows out of the throttle-side outlet 21*d*.

The refrigerant flowing out of the throttle-side outlet 21*d* flows into the first evaporator 17 via the first connection passage 19*a* of the collection pipe 19. The refrigerant flowing into the first evaporator 17 absorbs heat from the ventilation air after passing through the second evaporator 18 and evaporates there. Thus, the ventilation air after passing through the second evaporator 18 is further cooled. The refrigerant flowing out of the first evaporator 17 is drawn from the refrigerant suction port 21*b* via the second connection passage 19*b* of the collection pipe 19.

As mentioned above, the ejector refrigeration cycle 10 of the present embodiment can cool the ventilation air to be blown into the vehicle cabin, in the first evaporator 17 and the second evaporator 18.

In the ejector refrigeration cycle 10 of the present embodiment, the refrigerant on the downstream side of the second evaporator 18, i.e., the refrigerant pressurized by the diffuser 52 of the ejector 15 can be drawn into the compressor 11. Therefore, the ejector refrigeration cycle 10 can reduce the power consumption of the compressor 11 to thereby improve the coefficient of performance (COP) of the refrigerant cycle, compared to a normal refrigeration cycle device where a refrigerant evaporation pressure is substantially equal to a suction refrigerant pressure in the evaporator.

In the ejector refrigeration cycle 10 of the present embodiment, the refrigerant evaporation pressure in the second evaporator 18 can be set at a refrigerant pressure pressurized by the diffuser 52, while the refrigerant evaporation pressure in the first evaporator 17 can be set at a low refrigerant pressure obtained immediately after the decompression in the nozzle 51. Therefore, the ejector refrigeration cycle can ensure the temperature difference between the refrigerant evaporation temperature and the ventilation air temperature in each evaporator, thereby effectively cooling the ventilation air.

The ejector module 20 of the present embodiment includes the ejector 15 and the variable throttle mechanism 16. The ejector 15 includes a variable nozzle that is constituted of the nozzle 51, the needle valve 53, the nozzle-side driving mechanism 54, and the like. The variable throttle mechanism 16 is constituted of the throttle passage 20*a*, the throttle valve 61, the decompression-side driving mechanism 62, and the like.

Therefore, the flow rate of the refrigerant flowing into the nozzle 51 and the flow rate of the refrigerant flowing into the variable throttle mechanism 16 can be appropriately adjusted by changing the passage cross-sectional area of the nozzle 51 of the ejector 15 and the throttle opening degree of the variable throttle mechanism 16 in accordance with variations in the load on the ejector refrigeration cycle 10. Consequently, the ejector refrigeration cycle 10 can exhibit the high COP, regardless of variations in the load.

In the ejector module 20 of the present embodiment, the branch portion 14, the ejector 15 having the variable nozzle, and the variable throttle mechanism 16 are integrated together within the cycle configuration mechanism, thus making it possible to achieve a size reduction and an improvement in the productivity of the entire ejector refrigeration cycle 10.

However, the ejector 15 having the variable nozzle and the variable throttle mechanism 16 require a driving device (in the present embodiment, the nozzle-side driving mechanism 54 and the decompression-side driving mechanism 62) for changing the passage cross-sectional area or the throttle opening degree. Such a driving device has a relatively large body size, compared to the needle valve 53, the throttle valve 61, and the like. This makes it difficult to obtain the above-mentioned effect of reducing the size of the entire ejector module 20.

In this regard, in the ejector module 20 of the present embodiment, when viewed from the central axis direction of one of the nozzle-side central axis CL1 and the decompression-side central axis CL2, the driving portion corresponding to the one central axis and the other central axis are disposed to overlap each other when integrating the variable throttle mechanism 16 and the ejector 15.

With such an arrangement, the decompression-side driving mechanism 62 and the nozzle-side driving mechanism 54, which have relatively large body size, can be disposed to be shifted in the direction of either the central axis CL1 or CL2. Thus, a main body of the variable throttle mechanism 16 (i.e., a portion of the variable throttle mechanism 16 except for the decompression-side driving mechanism 62) can be brought close to a main body of the ejector 15 (i.e., a portion of the ejector 15 except for the nozzle-side driving mechanism 54).

The nozzle-side central axis CL1 and the decompression-side central axis CL2 have a twisted positional relationship, so that the main body of the variable throttle mechanism 16 can be effectively brought close to the main body of the ejector 15, without causing the decompression-side driving mechanism 62 and the nozzle-side driving mechanism 54 to interfere with each other. Thus, according to the ejector module 20 of the present embodiment, the size of the ejector refrigeration cycle 10 that uses the ejector module never increases even when the passage cross-sectional area of the ejector module is changeable.

In the ejector module 20 of the present embodiment, the outflow side passage 20*c* is formed in the body portion 21, and a part of the nozzle-side thermo-sensitive portion 54*a* of the nozzle-side driving mechanism 54 is disposed in a space that communicates with the outflow side passage 20*c*.

In this way, the nozzle-side thermo-sensitive portion 54*a* and the outflow side passage 20*c* can be brought close to each other. Therefore, the temperature and pressure of the refrigerant circulating through the outflow side passage 20*c* can be accurately sensed by the nozzle-side thermo-sensitive portion 54*a* without increasing the size of the ejector module 20.

In the ejector module 20 of the present embodiment, the suction side passage 20*b* is formed in the body portion 21, and a part of the decompression-side thermo-sensitive portion 62*a* of the decompression-side driving mechanism 62 is disposed in the suction side passage 20*b*.

Consequently, the decompression-side thermo-sensitive portion 62*a* and the suction side passage 20*b* can be brought close to each other. Therefore, the temperature and pressure of the refrigerant circulating through the suction side passage 20*b* can be accurately sensed by the decompression-side thermo-sensitive portion 62*a* without increasing the size of the ejector module 20.

In the ejector module 20 of the present embodiment, the decompression-side driving mechanism 62 displaces the throttle valve 61 such that the superheat degree of the refrigerant located on the outlet side of the first evaporator 17 approaches 0° C. Thus, the gas-liquid two-phase refrigerant with a low dryness can be prevented from being drawn from the refrigerant suction port 21*b* due to an excessive decrease in the dryness of the refrigerant flowing out of the first evaporator 17. Therefore, the reduction in the pressurizing performance of the ejector 15 can be suppressed.

Furthermore, the superheat degree of the refrigerant can be prevented from extremely increasing on the outlet side of the first evaporator 17, thus suppressing the formation of the inappropriate temperature distribution in the ventilation air cooled by the first evaporator 17. This is effective in easily suppressing the formation of the temperature distribution of the ventilation air across the entire ejector refrigeration cycle 10 in the configuration where the first evaporator 17 is disposed on the downstream side of the air flow with respect to the second evaporator 18, like the ejector refrigeration cycle 10 of the present embodiment.

In the ejector module 20 of the present embodiment, at least a part of the diffuser 52 is protruded from the body portion 21 and accommodated in the collection pipe 19. Thus, the collection pipe 19 with an appropriate shape can be adopted in accordance with the relatively positional relationship between the ejector module 20 and the second evaporator 18 in the ejector refrigeration cycle 10, further reducing the size of the ejector refrigeration cycle 10.

In the ejector module 20 of the present embodiment, the high-pressure inlet 21*a* and the low-pressure outlet 21*f* of the body portion 21 are opened in the same direction. The ejector-side outlet 21*c*, the low-pressure inlet 21*e*, the refrigerant suction port 21*b*, and the throttle-side outlet 21*d* are opened in the same direction.

In this way, the ejector-side outlet 21*c*, the low-pressure inlet 21*e*, the refrigerant suction port 21*b*, and the throttle-side outlet 21*d*, which are connected to the integrated first and second evaporators 17 and 18, are opened in the same direction, so that the ejector module 20 can be easily connected to the first evaporator 17 and the second evaporator 18.

The ejector module 20 of the present embodiment can function as a joint (connector) of the evaporator unit 200, thereby improving the assemblability of the ejector module 20 on the ejector refrigeration cycle 10. Consequently, the productivity of the entire ejector refrigeration cycle 10 can be further improved.

Second Embodiment

Figure 6:
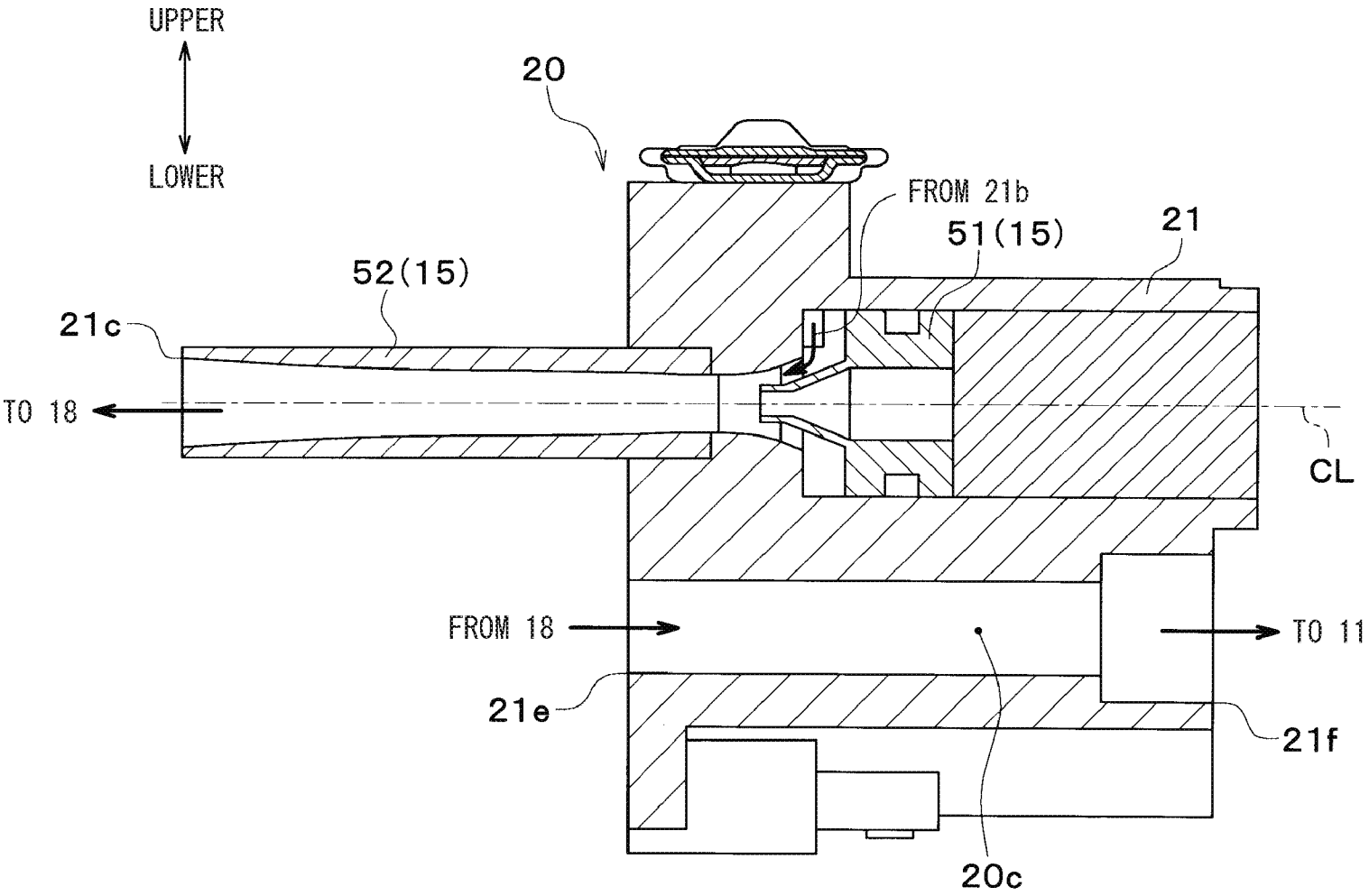
FIG. 6 is an axial cross-sectional view including the central axis of a nozzle in an ejector module of a second embodiment.
Figure 7:
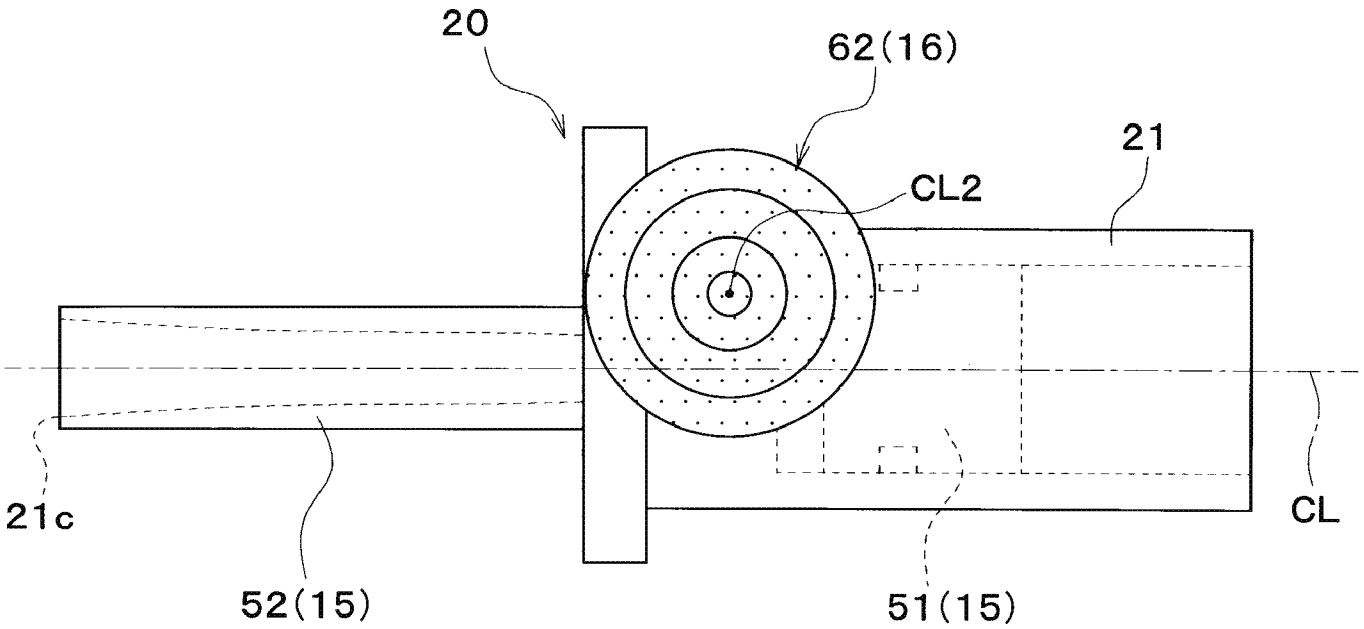
FIG. 7 is a top view of the ejector module of the second embodiment.

As shown in FIGS. 6 and 7, the present embodiment will describe an example in which the needle valve 53 of the ejector 15 and the nozzle-side driving mechanism 54 are eliminated from the first embodiment.

That is, the nozzle 51 of the ejector 15 in the present embodiment is a fixed nozzle that has unchangeable passage cross-sectional area. FIGS. 6 and 7 are diagrams corresponding to FIGS. 2 and 5 described in the first embodiment, respectively. In FIGS. 6 and 7, the same or equivalent parts as those of the first embodiment are denoted by the same reference characters. The same goes for the following drawings.

As can be seen from FIGS. 6 and 7, the ejector module 20 of the present embodiment has substantially the same positional relationship between the ejector 15 and the variable throttle mechanism 16 as that in the first embodiment. That is, the central axis CL of the nozzle 51 and the decompression-side central axis CL2 have the twisted positional relationship, and the decompression-side driving mechanism 62 occupying a region indicated by hatching with points in FIG. 7 and the central axis CL of the nozzle 51 are disposed to overlap each other when viewed from the direction of the decompression-side central axis CL2. As shown in FIG. 7, the central axis CL of the nozzle 51 is positioned within a range of the cross section perpendicular to the decompression-side central axis CL2 of the decompression-side driving mechanism 62.

The configurations and operations of other components of the ejector module 20 and the ejector refrigeration cycle 10 are the same as those of the first embodiment. Therefore, the ejector refrigeration cycle 10 in the present embodiment can also obtain the same effects as in the first embodiment.

More specifically, since the variable throttle mechanism 16 is connected to the other refrigerant outlet side of the branch portion 14, both the flow rate of the refrigerant flowing into the throttle passage 20*a* and the flow rate of the refrigerant flowing into the nozzle 51 can be adjusted by changing the throttle opening degree of the variable throttle mechanism 16. Consequently, the ejector refrigeration cycle 10 can exhibit the high COP, regardless of variations in the load.

In the ejector module 20 of the present embodiment, as viewed from the direction of the decompression-side central axis CL2, the decompression-side driving mechanism 62 and the central axis CL of the nozzle 51 are disposed to overlap each other when integrating the variable throttle mechanism 16 and the ejector 15.

With such an arrangement, the decompression-side driving mechanism 62, which has a relatively large body size, and the ejector 15, which is formed to extend in its axial direction, can be disposed to be shifted in the direction of the decompression-side central axis CL2. Thus, the main body of the variable throttle mechanism 16 (i.e., the portion of the variable throttle mechanism 16 except for the decompression-side driving mechanism 62) can be brought close to the ejector 15.

As the central axis CL1 of the nozzle 51 and the decompression-side central axis CL2 have a twisted positional relationship, the main body of the variable throttle mechanism 16 can be effectively brought close to the ejector 15, without causing the decompression-side driving mechanism 62 and the ejector 15 to interfere with each other. Therefore, according to the ejector module 20 of the present embodiment, the size of the ejector refrigeration cycle 10 that uses the ejector module never increases even when the passage cross-sectional area of the ejector module is configured to be changeable.

The ejector module 20 in the present embodiment eliminates the needle valve 53 and the nozzle-side driving mechanism 54. Because of this, the superheat degree of the refrigerant located on the outlet side of the first evaporator 17 cannot be appropriately adjusted with ease only by previously adjusting the passage cross-sectional area of the throat portion of the nozzle 51.

For this reason, in the ejector refrigeration cycle 10 of the present embodiment, an accumulator may be disposed between the low-pressure outlet 21*f* of the ejector module 20 and the suction port of the compressor 11 so as to separate the low-pressure refrigerant into gas and liquid-phase refrigerants and to cause the separated gas-phase refrigerant to flow out to the suction port of the compressor 11.

Third Embodiment

Figure 8:
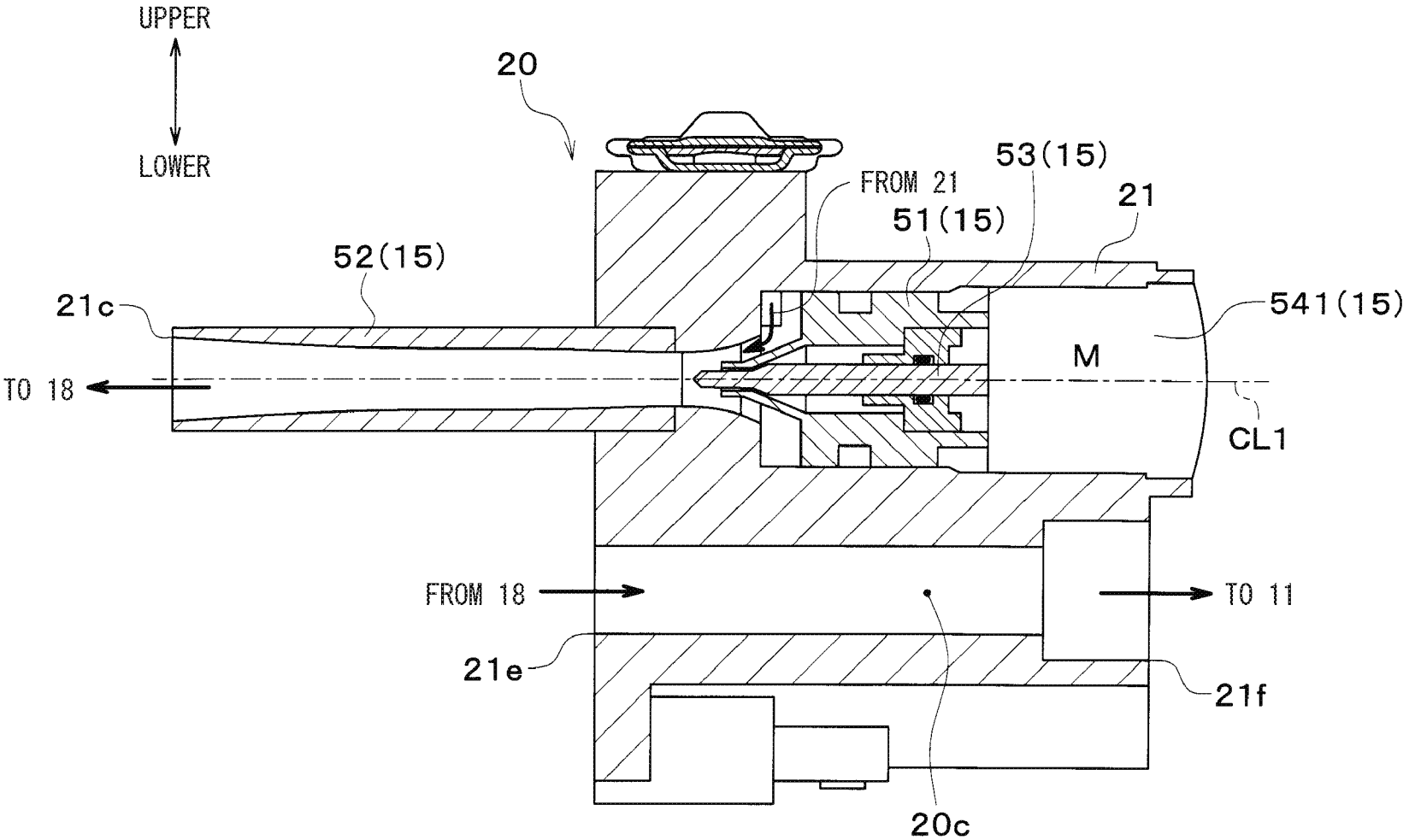
FIG. 8 is an axial cross-sectional view including a nozzle-side central axis of an ejector module of a third embodiment.

As shown in FIG. 8, the present embodiment employs an electric nozzle-side driving mechanism 541 that has an actuator, such as a stepping motor, as a nozzle-side driving portion, compared to the first embodiment. The nozzle-side driving mechanism 541 has its operation controlled by a control signal (control pulse) output from the air-conditioning controller. FIG. 8 is a diagram corresponding to FIG. 2 described in the first embodiment.

Like the first embodiment, in the ejector module 20 of the present embodiment, the nozzle-side central axis CL1 and the decompression-side central axis CL2 have a twisted positional relationship. When viewed from the central axis direction of one of the nozzle-side central axis CL1 and the decompression-side central axis CL2, the driving portion corresponding to the one central axis and the other central axis are disposed to overlap each other.

The configurations and operations of other components of the ejector module 20 are the same as those in the first embodiment. Therefore, the ejector module 20 in the present embodiment can also obtain the same effects as in the first embodiment, even though the configuration of the nozzle-side driving portion is changed.

Fourth Embodiment

Figure 9:
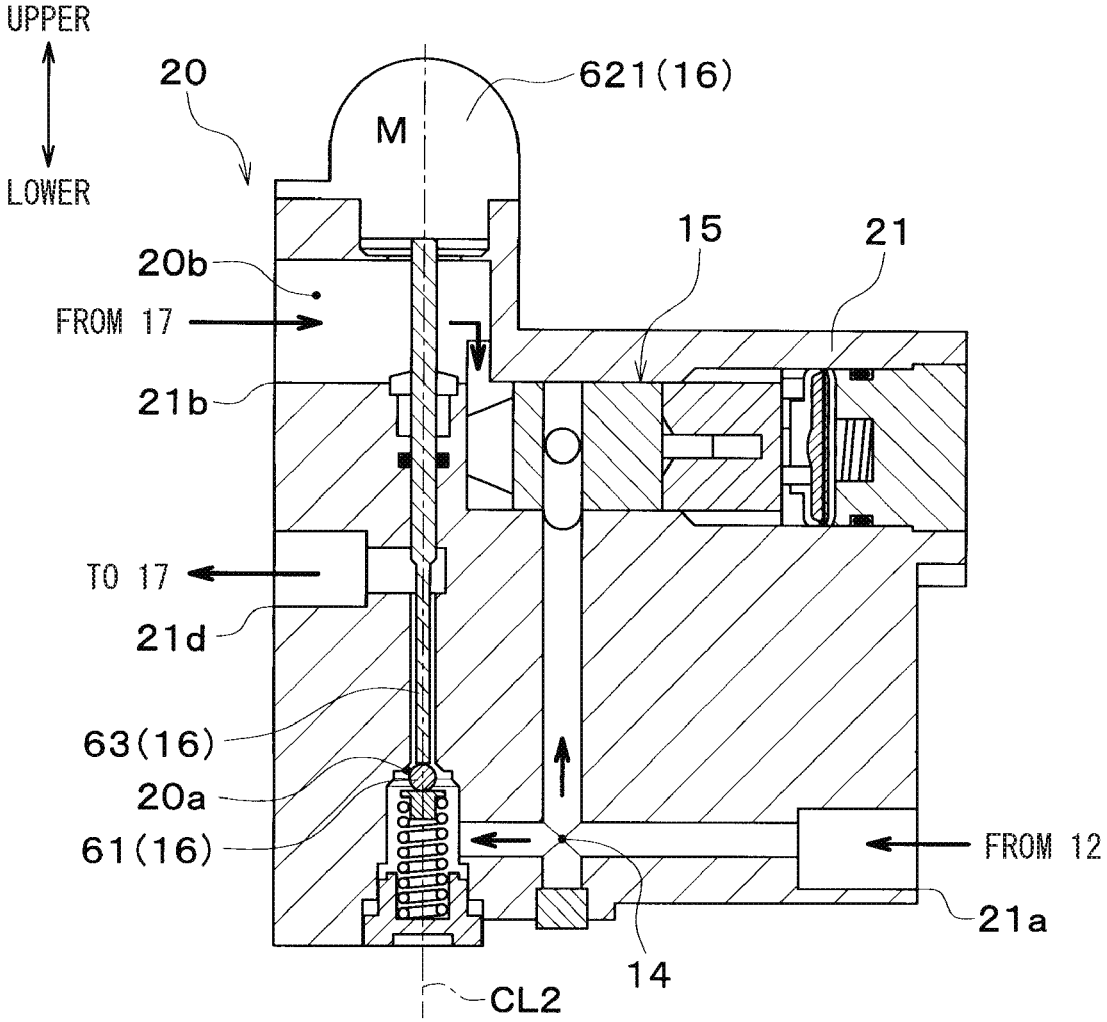
FIG. 9 is an axial cross-sectional view including a decompression-side central axis of an ejector module of a fourth embodiment.

As shown in FIG. 9, the present embodiment employs an electric decompression-side driving mechanism 621 that has an actuator, such as a stepping motor, as a decompression-side driving portion, compared to the first embodiment. The decompression-side driving mechanism 621 has its operation controlled by a control signal (control pulse) output from the air-conditioning controller. FIG. 9 is a diagram corresponding to FIG. 3 described in the first embodiment.

Like the first embodiment, in the ejector module 20 of the present embodiment, the nozzle-side central axis CL1 and the decompression-side central axis CL2 have a twisted positional relationship. When viewed from the central axis direction of one of the nozzle-side central axis CL1 and the decompression-side central axis CL2, the driving portion corresponding to the one central axis and the other central axis are disposed to overlap each other.

The configurations and operations of other components of the ejector module 20 are the same as those in the first embodiment. Therefore, the ejector module 20 in the present embodiment can also obtain the same effects as in the first embodiment, even though the configuration of the decompression-side driving portion is changed.

Fifth Embodiment

Figure 10:
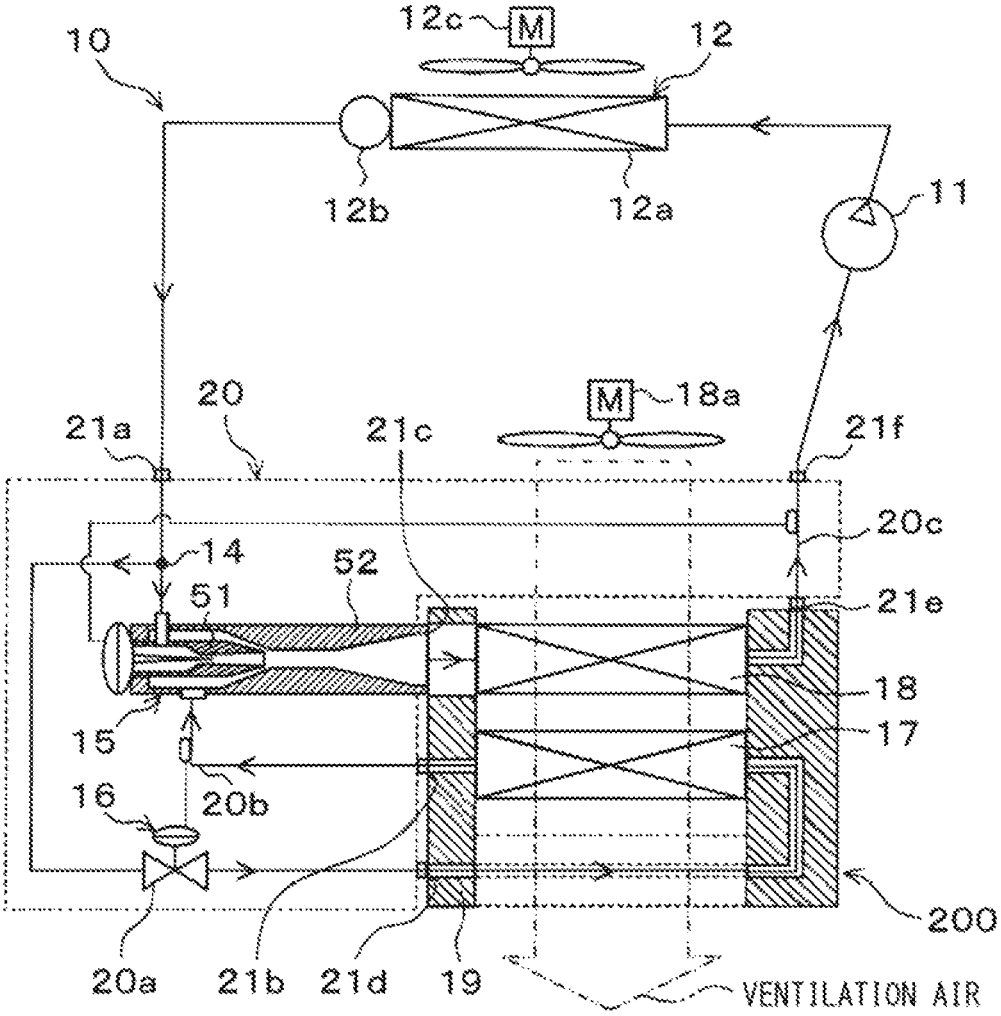
FIG. 10 is an entire schematic configuration diagram of an ejector refrigeration cycle of a fifth embodiment.

In the present embodiment, as shown in FIG. 10, the ejector-side outlet 21*c* is opened in the same direction as the low-pressure inlet 21*e*, the refrigerant suction port 21*b*, and the throttle-side outlet 21*d*, and is opened on the same plane as the outer surface of the body portion 21.

The configurations and operations of other components of the ejector module 20 are the same as those in the first embodiment. Therefore, the ejector module 20 of the present embodiment can also obtain the same effects as in the first embodiment. Like the present embodiment, the ejector-side outlet 21*c* is disposed on the same plane as the other refrigerant inlets/outlets 21*b* to 21*d* and thereby can improve the assemblability of the ejector refrigeration cycle 10.

Sixth Embodiment

Figure 11:
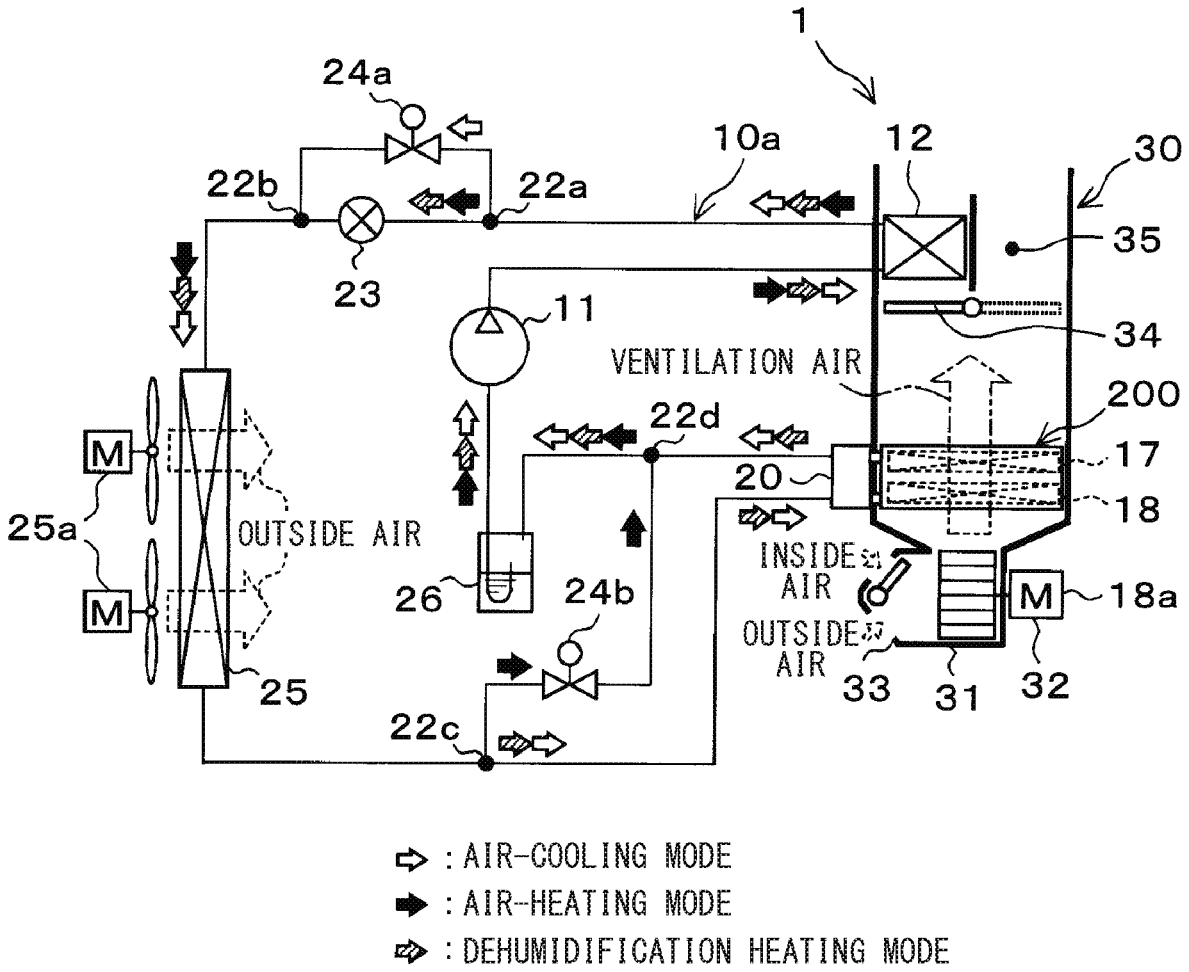
FIG. 11 is an entire schematic configuration diagram of an ejector refrigeration cycle of a sixth embodiment.

The present embodiment will describe an example in which the evaporator unit 200 using the ejector module 20 described in the fourth embodiment is used in an ejector refrigeration cycle 10*a* shown in the entire configuration diagram of FIG. 11.

The ejector refrigeration cycle 10*a* is used in a vehicle air conditioner 1 and serves to cool or heat the ventilation air to be blown into the interior of the vehicle cabin as a space to be air-conditioned. The ejector refrigeration cycle 10*a* is configured to be capable of switching among a refrigerant circuit in an air-cooling mode, a refrigerant circuit in a dehumidification heating mode, and a refrigerant circuit in an air-heating mode.

In the vehicle air conditioner 1, the air-cooling mode is an operation mode of performing air-cooling of the vehicle interior by blowing the cooled ventilation air into the vehicle cabin. The air-heating mode is an operation mode of performing air-heating of the vehicle interior by blowing the heated ventilation air into the vehicle cabin. The dehumidification heating mode is an operation mode of performing dehumidification and air-heating of the vehicle interior by reheating the cooled and dehumidified ventilation air and then blowing the heated ventilation air into the vehicle cabin.

In FIG. 11, the flow of the refrigerant within the refrigerant circuit in the air-cooling mode is indicated by outlined arrows. The flow of the refrigerant within the refrigerant circuit in the air-heating mode is indicated by black arrows. The flow of the refrigerant within the refrigerant circuit in the dehumidification heating mode is indicated by hatched arrows.

In the ejector refrigeration cycle 10*a*, the radiator that has only the condensing portion, such as that described in the first embodiment, is employed as the radiator 12. In the present embodiment, the radiator 12 is disposed in a casing 31 of an interior air-conditioning unit 30 to be described later. Therefore, the radiator 12 of the present embodiment can be expressed as an interior condenser.

A refrigerant outlet of the radiator 12 is connected to an inflow port side of a first three-way joint 22*a* that has three inlets/outlets that communicate with each other. As such a three-way joint, a joint formed by joining a plurality of pipes or a joint formed by providing a plurality of refrigerant passages in a metal block or a resin block can be employed.

The three-way joint functions as a branch portion that branches the flow of the refrigerant by using one of the three inflow/outflow ports as the inflow port and the remaining two as the outflow ports. The three-way joint functions as a merging portion that merges two refrigerant flows by using two of the three inflow/outflow ports as the inflow ports and the remaining one as the outflow port.

The ejector refrigeration cycle 10*a* includes second to fourth three-way joints 22*b* to 22*d* as described later. Each of these second to fourth three-way joints 22*b* to 22*d* has substantially the same basic structure as the first three-way joint 22*a*.

One outflow port of the first three-way joint 22*a* is connected to one inflow port side of the second three-way joint 22*b* via an air-heating expansion valve 23. The other outflow port of the first three-way joint 22*a* is connected to the other inflow port side of the second three-way joint 22*b* via a first on-off valve 24*a*. An outflow port of the second three-way joint 22*b* is connected to a refrigerant inlet side of an exterior heat exchanger 25.

The air-heating expansion valve 23 is a decompression device that decompresses a high-pressure refrigerant flowing out of the radiator 12 at least in the air-heating mode. The air-heating expansion valve 23 is an electric variable throttle mechanism that includes a valve body configured to have a variable throttle opening degree and an electric actuator configured to change the throttle opening degree of the valve body. The air-heating expansion valve 23 has its operation controlled by a control signal (control pulse) output from the air-conditioning controller.

The first on-off valve 24*a* is a solenoid valve that opens and closes a bypass passage connecting the other outflow port of the first three-way joint 22*a* and the other inflow port of the second three-way joint 22*b*. The ejector refrigeration cycle 10*a* includes a second on-off valve 24*b* to be described later. The second on-off valve 24*b* has substantially the same basic structure as the first three-way joint 22*a*. Each of the first and second on-off valves 24*a* and 24*b* has its operation controlled by a control voltage output from the air-conditioning controller.

A pressure loss caused when the refrigerant passes through the first on-off valve 24*a* is extremely small, compared to a pressure loss caused when the refrigerant passes through the air-heating expansion valve 23. Therefore, when the first on-off valve 24*a* is opened, the refrigerant flowing from the radiator 12 into the first three-way joint 22*a* hardly flows out to the air-heating expansion valve 23 side, but flows out to the first on-off valve 24*a* side.

The exterior heat exchanger 25 is a heat exchanger that exchanges heat between the refrigerant flowing out of the air-heating expansion valve 23 and the outside air blown from an outside air fan 25*a*. The exterior heat exchanger 25 is disposed at the front side in the vehicle bonnet.

The exterior heat exchanger 25 functions as a radiator that dissipates heat from the high-pressure refrigerant at least in the air-cooling mode, and also functions as an evaporator that evaporates the low-pressure refrigerant decompressed by the air-heating expansion valve 23 at least in the air-heating mode. The outside air fan 25*a* is an electric blower that has the rotation speed (i.e., blowing capacity) controlled by a control voltage output from the air-conditioning controller.

The refrigerant outlet of the exterior heat exchanger 25 is connected to an inflow port of a third three-way joint 22*c*. One outflow port of the third three-way joint 22*c* is connected to the refrigerant inlet side of the evaporator unit 200 (i.e., the high-pressure inlet 21*a* side of the ejector module 20). The refrigerant outlet of the evaporator unit 200 (i.e., the low-pressure outlet 21*f* of the ejector module 20) is connected to one inflow port of a fourth three-way joint 22*d*.

The other outflow port of the third three-way joint 22*c* is connected to the other inflow port of the fourth three-way joint 22*d* via the second on-off valve 24*b*. An outflow port of the fourth three-way joint 22*d* is connected to the inlet side of an accumulator 26. The accumulator 26 is a gas-liquid separator that separates the refrigerant flowing thereinto, into gas and liquid phase refrigerants to store an excess liquid-phase refrigerant in the refrigerant cycle. A gas-phase refrigerant outlet of the accumulator 26 is connected to the suction port side of the compressor 11.

Figure 12:
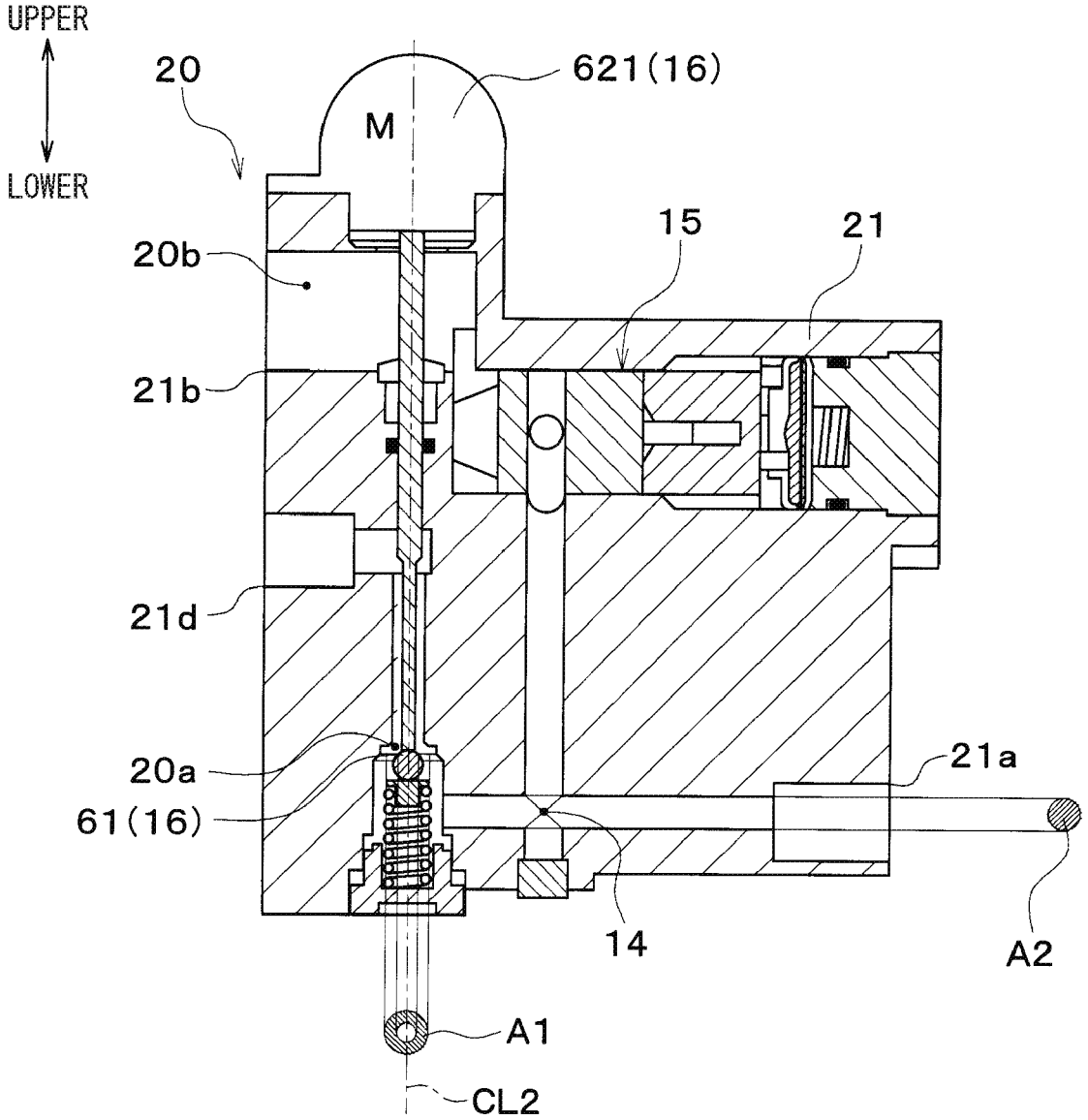
FIG. 12 is an axial cross-sectional view including a decompression-side central axis of an ejector module of the sixth embodiment.

In the ejector module 20 of the present embodiment, as shown in FIG. 12, the maximum passage cross-sectional area A1, obtained when the decompression-side driving mechanism 621 displaces the throttle valve 61 to fully open the throttle passage 20*a*, is set equal to or more than the minimum passage cross-sectional area A2 of the refrigerant passage (A1≥A2) that leads from the high-pressure inlet 21*a* to the throttle passage 20*a* (in other words, the refrigerant passage on the upper stream side with respect to the throttle passage 20*a*). FIG. 12 is a diagram corresponding to FIG. 9 described in the fourth embodiment.

Thus, a pressure loss caused when the refrigerant passes through the throttle passage 20*a* is extremely small, compared to a pressure loss caused when the refrigerant passes through the nozzle 51 of the ejector module 20. Therefore, when the throttle passage 20*a* is fully opened, most of the refrigerant flowing into the high-pressure inlet 21*a* of the ejector module 20 hardly flows from the branch portion 14 to the nozzle 51 side, but flows from the branch portion 14 to the throttle passage 20*a* side.

The configurations of other components of the ejector refrigeration cycle 10 are the same as those of the ejector refrigeration cycle 10 in the first embodiment.

Next, the interior air-conditioning unit 30 will be described. The interior air-conditioning unit 30 is disposed inside a dashboard (instrumental panel) at the foremost portion of the interior of the vehicle cabin. The interior air-conditioning unit 30 is to blow out the ventilation air having its temperature adjusted by the ejector refrigeration cycle 10*a*, into an appropriate position inside the vehicle cabin.

As shown in FIG. 11, the interior air-conditioning unit 30 accommodates the blower 18*a*, the evaporator unit 200, the radiator 12, and the like, in an air passage formed inside the casing 31, which forms an outer shell of the interior air-conditioning unit 30.

The casing 31 forms an air passage for the ventilation air to be blown into the interior of the vehicle cabin. The casing 31 is formed of resin (for example, polypropylene) with some elasticity and excellent strength. An inside/outside air switch 33 is disposed on the most upstream side of the ventilation-air flow in the casing 31 so as to switch between the inside air (air inside the vehicle cabin) and the outside air (air outside the vehicle cabin) to guide the selected air into the casing 31.

The inside/outside air switch 33 continuously adjusts the opening areas of an inside-air introduction port for introducing the inside air into the casing 31 and an outside-air introduction port for introducing the outside air thereinto by means of an inside/outside air switching door, thereby changing the ratio of the introduced volume of the inside air to that of the outside air. The inside/outside air switching door is driven by an electric actuator for the inside/outside air switching door, and the electric actuator has its operation controlled by a control signal output from the air-conditioning controller.

The blower 18*a* is disposed on the downstream side of the ventilation-air flow with respect to the inside/outside air switch 33. The evaporator unit 200 and the radiator 12 are disposed on the downstream side of the ventilation-air flow with respect to the blower 18*a* in this order. That is, the evaporator unit 200 is disposed on the upstream side of the ventilation air flow with respect to the radiator 12.

A cold-air bypass passage 35 is formed inside the casing 31 to cause the ventilation air passing through the evaporator unit 200 to flow downstream while bypassing the radiator 12.

An air mix door 34 is disposed on the downstream side of the ventilation-air flow with respect to the evaporator unit 200 and on the upstream side of the ventilation-air flow with respect to the radiator 12. The air mix door 34 adjusts the rate of the volume of the air passing through the evaporator unit 200 to the volume of the air passing through the cold-air bypass passage 35 in the ventilation air after passing through the evaporator unit 200.

A mixing space is provided on the downstream side of the ventilation-air flow with respect to the radiator 12 so as to mix the ventilation air heated by the radiator 12 with the ventilation air passing through the cold-air bypass passage 35 and not heated by the radiator 12. Openings are provided on the most downstream portion in the ventilation-air flow direction of the casing 31 so as to blow the ventilation air (conditioned air) mixed in the mixing space, into the interior of the vehicle cabin.

The openings include a face opening, a foot opening, and a defroster opening (all of which are not shown). The face opening is an opening for blowing the conditioned air toward the upper body of an occupant in the vehicle cabin. The foot opening is an opening for blowing the conditioned air toward the feet of the occupant in the vehicle cabin. The defroster opening is an opening for blowing the conditioned air toward the inner surface of a windshield of the vehicle.

The face opening, the foot opening, and the defroster opening are connected to a face air outlet, a foot air outlet, and a defroster air outlet (all of which are not shown), which are provided in the vehicle cabin, respectively, via ducts formed in their air passages.

Thus, the air mix door 34 adjusts the ratio of the volume of the air passing through the radiator 12 to the volume of the air passing through the cold-air bypass passage 35, thereby regulating the temperature of the conditioned air to be mixed in the mixing space. In this way, the temperature of the ventilation air (conditioned air) blown from the respective air outlets into the vehicle cabin is also controlled.

The air mix door 34 is driven by an electric actuator for driving the air mix door. The electric actuator has its operation controlled by a control signal output from the air-conditioning controller.

A face door, a foot door, and a defroster door (all of which are not shown) are disposed on the ventilation-air flow upstream side of the face opening, the foot opening, and the defroster opening, respectively. The face door adjusts an opening area of the face opening. The foot door adjusts an opening area of the foot opening. The defroster door adjusts an opening area of the defroster opening.

These face door, foot door, and defroster door constitute a blowing mode switching device that switches the air outlet through which the conditioned air is blown out. The face door, foot door, and defroster door are rotatably operated via link mechanisms or the like in conjunction with the respective electric actuators for driving the air-outlet mode doors. These electric actuators have their operations controlled by control signals output from the air-conditioning controller.

Now, the operation of the vehicle air conditioner with the above-mentioned configuration in the present embodiment will be described. The vehicle air conditioner 1 in the present embodiment can perform the air-cooling, the air-heating, and the dehumidification heating of the interior of the vehicle cabin. In response to this air-conditioning, the ejector refrigeration cycle 10*a* can switch among the operations in the air-cooling mode, the air-heating mode, and the dehumidification heating mode. The switching among these operation modes is performed by executing an air-conditioning control program stored in the air-conditioning controller.

The air-conditioning control program is designed to switch the refrigerant circuit based on a target air outlet temperature TAO and an outside air temperature Tam of the ventilation air blown into the vehicle cabin. More specifically, the air-conditioning control program is switched from the air-heating mode to the dehumidification heating mode and the air-cooling mode in this order together with an increase in the target air outlet temperature TAO or the outside air temperature Tam. Hereinafter, the operation of the ejector refrigeration cycle in each operation mode will be described.

(a) Air-Cooling Mode

In the air-cooling mode, the air-conditioning controller controls the operation of the decompression-side driving mechanism 621 such that while the air-heating expansion valve 23 is in a completely closed state, the first on-off valve 24*a* is opened, the second on-off valve 24*b* is closed, and the throttle passage 20*a* of the ejector module 20 exhibits a refrigerant decompression effect.

Thus, as indicated by outlined arrows in FIG. 11, the ejector refrigeration cycle 10*a* of the air-cooling mode is configured to cause the refrigerant to circulate from the compressor 11 (to the radiator 12), to the first on-off valve 24*a*, the exterior heat exchanger 25, the evaporator unit 200, the accumulator 26, and then the compressor 11 in this order.

In the cycle configuration, the air-conditioning controller determines a target evaporator temperature TEO of the ventilation air blown out of the evaporator unit 200 based on the target air outlet temperature TAO with reference to a control map pre-stored in the air-conditioning controller. Then, the air-conditioning controller controls the operation of the compressor 11 such that the evaporator temperature of the first evaporator 17 in the evaporator unit 200 approaches the target evaporator temperature TEO.

The target evaporator temperature TEO is determined by the control map so as to decrease with decreasing target air outlet temperature TAO. The target evaporator temperature TEO is determined to be a value (specifically, 1° C. or higher) within a range that can suppress frost formation of the first evaporator 17 and the second evaporator 18.

The air-conditioning controller displaces the air mix door 34 such that a ventilation passage on the radiator 12 side is completely closed, and a ventilation passage on the cold-air bypass passage 35 side is fully opened.

Therefore, in the air-cooling mode, the high-pressure refrigerant discharged from the compressor 11 flows into the radiator 12. In the air-cooling mode, the air mix door 34 completely closes the ventilation passage on the radiator 12 side, so that the high-pressure refrigerant flowing into the radiator 12 flows out of the radiator 12 without dissipating heat into the ventilation air. The high-pressure refrigerant flowing out of the radiator 12 flows into the exterior heat exchanger 25 via the first on-off valve 24*a*.

The high-pressure refrigerant flowing into the exterior heat exchanger 25 exchanges heat with the outside air blown by the outside air fan 25*a* to dissipate heat and is then condensed therein. The refrigerant condensed in the exterior heat exchanger 25 flows into the evaporator unit 200 (specifically, the high-pressure inlet 21*a* of the ejector module 20). The refrigerant flowing into the ejector module 20 absorbs heat from the ventilation air to evaporate in the first evaporator 17 and the second evaporator 18, in the same manner as in the first embodiment.

The refrigerant flowing out of the evaporator unit 200 (specifically, the low-pressure outlet 21*f* of the ejector module 20) flows into the accumulator 26. The gas-phase refrigerant separated by the accumulator 26 is drawn into the compressor 11.

That is, the ejector refrigeration cycle 10*a* in the air-cooling mode is configured as the refrigeration cycle where the exterior heat exchanger 25 functions as the radiator, and the first evaporator 17 and the second evaporator 18 of the evaporator unit 200 function as evaporators. Therefore, in the air-cooling mode, the ventilation air cooled by the first evaporator 17 and the second evaporator 18 of the evaporator unit 200 is blown into the vehicle cabin, thereby enabling the air-cooling of the interior of the vehicle cabin.

(b) Air-Heating Mode

In the air-heating mode, the air-conditioning controller controls the operation of the decompression-side driving mechanism 621 such that while the air-heating expansion valve 23 is in a throttle state of exhibiting a refrigerant decompression effect, the first on-off valve 24*a* is closed, the second on-off valve 24*b* is opened, and the throttle passage 20*a* of the ejector module 20 is closed.

Thus, as indicated by black arrows in FIG. 11, the ejector refrigeration cycle 10*a* of the air-heating mode is configured to cause the refrigerant to circulate from the compressor 11 to the radiator 12, the air-heating expansion valve 23, the exterior heat exchanger 25, the second on-off valve 24*b*, the accumulator 26, and then the compressor 11 in this order.

In the cycle configuration, the air-conditioning controller determines a target condenser pressure PCO of the high-pressure refrigerant flowing into the radiator 12 based on the target air outlet temperature TAO with reference to a control map pre-stored in the air-conditioning controller. Then, the air-conditioning controller controls the operation of the compressor 11 such that the pressure of the high-pressure refrigerant flowing into the radiator 12 approaches the target condenser pressure PCO.

The control map is determined such that the target condenser pressure PCO increases with increasing target air outlet temperature TAO.

The air-conditioning controller displaces the air mix door 34 such that a ventilation passage on the radiator 12 side is fully opened, and a ventilation passage on the cold-air bypass passage 35 side is completely closed.

Therefore, in the air-heating mode, the high-pressure refrigerant discharged from the compressor 11 flows into the radiator 12. In the air-heating mode, the air mix door 34 fully opens the ventilation passage on the radiator 12 side, so that the high-pressure refrigerant flowing into the radiator 12 exchanges heat with the ventilation air to dissipate heat therefrom. The refrigerant flowing out of the radiator 12 flows into and is decompressed by the air-heating expansion valve 23. The low-pressure refrigerant decompressed by the air-heating expansion valve 23 flows into the exterior heat exchanger 25.

The low-pressure refrigerant flowing into the exterior heat exchanger 25 absorbs heat from the outside air blown by the outside air fan 25*a* to evaporate. The refrigerant evaporated in the exterior heat exchanger 25 hardly flows into the evaporator unit 200 side (specifically, the ejector module 20 side) and flows into the accumulator 26 via the second on-off valve 24*b* because the second on-off valve 24*b* is opened. The gas-phase refrigerant separated by the accumulator 26 is drawn into the compressor 11.

That is, the ejector refrigeration cycle 10*a* in the air-heating mode is configured as the refrigeration cycle where the radiator 12 functions as the radiator, and the exterior heat exchanger 25 functions as the evaporator. Therefore, in the air-heating mode, the air-heating of the vehicle interior can be performed by blowing the ventilation air heated by the radiator 12, into the vehicle cabin.

(c) Dehumidification Heating Mode

In the dehumidification heating mode, the air-conditioning controller controls the operation of the decompression-side driving mechanism 621 such that while the air-heating expansion valve 23 is in the throttle state, the first on-off valve 24*a* is closed, the second on-off valve 24*b* is closed, and the throttle passage 20*a* of the ejector module 20 is fully opened.

Thus, as indicated by hatched arrows in FIG. 11, the ejector refrigeration cycle 10*a* in the dehumidification heating mode is configured to cause the refrigerant to circulate from the compressor 11 to the radiator 12, the air-heating expansion valve 23, the exterior heat exchanger 25, the evaporator unit 200, the accumulator 26, and the compressor 11 in this order.

With the cycle configuration, the air-conditioning controller controls the operation of the compressor 11 in the same manner as in the air-cooling mode. Thus, also in the dehumidification heating mode, the refrigerant evaporation temperature at the first evaporator 17 and the second evaporator 18 is set to 1° C. or higher.

The air-conditioning controller displaces the air mix door 34 such that a ventilation passage on the radiator 12 side is fully opened, and a ventilation passage on the cold-air bypass passage 35 side is completely closed.

Therefore, in the dehumidification heating mode, the high-pressure refrigerant discharged from the compressor 11 flows into the radiator 12. In the dehumidification heating mode, the air mix door 34 fully opens the ventilation passage on the radiator 12 side, so that the high-pressure refrigerant flowing into the radiator 12 exchanges heat with the ventilation air to dissipate heat therefrom. The refrigerant flowing out of the radiator 12 flows into and is decompressed by the air-heating expansion valve 23. The low-pressure refrigerant decompressed by the air-heating expansion valve 23 flows into the exterior heat exchanger 25.

The low-pressure refrigerant flowing into the exterior heat exchanger 25 absorbs heat from the outside air blown by the outside air fan 25*a* to evaporate. The refrigerant evaporated in the exterior heat exchanger 25 flows into the evaporator unit 200 (specifically, the high-pressure inlet 21*a* of the ejector module 20) because the second on-off valve 24*b* is closed.

The refrigerant flowing into the evaporator unit 200 flows into the throttle passage 20*a* side almost without flowing into the nozzle 51 side because the throttle passage 20*a* is fully opened. Then, the refrigerant flows from the first evaporator 17 to the refrigerant suction port 21*b* of the ejector 15, the diffuser 52 of the ejector 15, and the second evaporator 18 in this order. At this time, the refrigerant absorbs heat from the ventilation air in the first evaporator 17 and the second evaporator 18 to further evaporate.

The refrigerant flowing out of the evaporator unit 200 (specifically, the low-pressure outlet 21*f* of the ejector module 20) flows into the accumulator 26. The gas-phase refrigerant separated by the accumulator 26 is drawn into the compressor 11.

That is, the ejector refrigeration cycle 10*a* in the dehumidification heating mode is configured as the refrigeration cycle where the radiator 12 functions as the radiator, and the exterior heat exchanger 25, the first evaporator 17, and the second evaporator 18 function as the evaporator. Therefore, in the dehumidification heating mode, the ventilation air cooled and dehumidified by the first evaporator 17 and the second evaporator 18 of the evaporator unit 200 is reheated in the radiator 12 and blown into the vehicle cabin, thereby enabling the dehumidification and air-heating of the interior of the vehicle cabin.

In the dehumidification heating mode, the ventilation air is reheated using, as a heat source, heat absorbed by the refrigerant from the outside air in the exterior heat exchanger 25 and heat absorbed by the refrigerant from the ventilation air in the first evaporator 17 and the second evaporator 18. Therefore, to improve the heating capacity of the ventilation air in the dehumidification heating mode, it is necessary to increase the amount of heat absorption by the refrigerant in the exterior heat exchanger 25, the first evaporator 17, and the second evaporator 18.

In the dehumidification heating mode, the exterior heat exchanger 25, the first evaporator 17, and the second evaporator 18 are sequentially connected in series with respect to the refrigerant flow to form the refrigerant circuit. Thus, the refrigerant evaporation temperature in the exterior heat exchanger 25 cannot be lower than each of the refrigerant evaporation temperatures of the first evaporator 17 and the second evaporator 18.

Therefore, to improve the heating capacity in the dehumidification heating mode, the ejector refrigeration cycle 10*a* reduces the refrigerant evaporation temperatures of the first evaporator 17 and the second evaporator 18 within a range that can suppress the frost formation. It is also effective that the refrigerant evaporation temperature in the exterior heat exchanger 25 approaches the respective refrigerant evaporation temperatures of the first evaporator 17 and the second evaporator 18.

In the ejector module 20 of the present embodiment, the maximum passage cross-sectional area A1, obtained when the throttle passage 20*a* is fully opened, is set equal to or more than the minimum passage cross-sectional area A2 of the refrigerant passage on the upstream side with respect to the throttle passage 20*a*.

Thus, the ejector motor 20 can suppress an increase in the pressure loss caused when the refrigerant passes through the fully opened throttle passage 20*a*. Therefore, the refrigerant evaporation temperature in the exterior heat exchanger 25 can be made to approach the respective refrigerant evaporation temperatures of the first evaporator 17 and the second evaporator 18. Consequently, the reduction in the amount of heat absorption by the exterior heat exchanger 25 can be suppressed, and thereby the reduction in the heating capacity of the ejector refrigeration cycle can also be suppressed when reheating the ventilation air.

As mentioned above, the ejector module 20 of the present embodiment can be used in the ejector refrigeration cycle that is switched to a refrigerant circuit in which the exterior heat exchanger 25, the first evaporator 17, and the second evaporator 18 are connected in series with respect to the refrigerant flow. This is useful in that the ejector module 20 can be used in a wider variety of the ejector refrigeration cycles.

Other Embodiments

The present disclosure is not limited to the above-mentioned embodiments, and various modifications and changes can be made to those embodiments without departing from the spirit of the present disclosure in the following ways.

(1) Although in the above-mentioned respective embodiments, the ejector module 20 according to the present disclosure is used in the ejector refrigeration cycle 10 mounted on vehicles by way of example, the usage of the ejector module 20 is not limited thereto. For example, the ejector module may also be used in any ejector refrigeration cycle, which is used in a stationary air conditioner, a cold storage unit, or the like.

(2) Although the above-mentioned first embodiment has described the ejector module 20 that includes the variable throttle mechanism 16 and the ejector 15 having the variable nozzle, the ejector module 20 is not limited thereto. At least one of the throttle passage 20*a* and the nozzle 51 may be configured to have the changeable passage cross-sectional area so as to make the flow rate of the refrigerant flowing into the throttle passage 20*a* and the nozzle 51 approach the appropriate flow rate, in accordance with variations in the load on the ejector refrigeration cycle 10.

Therefore, as mentioned in the second embodiment, the variable throttle mechanism 16 may be employed, and concurrently the ejector 15 having a fixed nozzle may be employed. The throttle valve 61 and the decompression-side driving mechanism 62 may be eliminated from the configuration of the first embodiment. That is, instead of the variable throttle mechanism 16, a fixed throttle may be employed, and concurrently the ejector 15 having a variable nozzle may be employed.

Although the first embodiment has described an example in which the nozzle-side thermo-sensitive portion 54*a* is disposed in the space that communicates with the outflow side passage 20*c*, at least a part of the nozzle-side thermo-sensitive portion 54*a* may be disposed in the outflow side passage 20*c*. Furthermore, although a part of the decompression-side driving mechanism 62 is disposed in the suction side passage 20*b* by way of example, the decompression-side driving mechanism 62 may be disposed in a space that communicates with the suction side passage 20*b*.

Although the first embodiment has described an example in which at least a part of the diffuser 52 is accommodated in the collection pipe 19, at least a part of the diffuser may be accommodated in the second evaporator 18 (for example, a collection-distribution tank).

(3) The respective components forming the ejector refrigeration cycles 10 and 10*a* are not limited to those disclosed in the above-mentioned embodiments.

Although the above-mentioned embodiments have described an example of employing an electric compressor as the compressor 11, the compressor 11 may adopt an engine-driven compressor that is driven by a rotational driving force transferred from a vehicle running engine via a pulley, a belt, etc. The engine-driven compressor can employ a variable displacement compressor that can adjust the refrigerant discharge capacity by changing its discharge displacement, or a fixed displacement compressor that can adjust the refrigerant discharge capacity by changing its operating rate through the connection/disconnection of an electromagnetic clutch, or the like.

Although the above-mentioned first to fifth embodiments have described an example of employing the receiver-integrated condenser as the radiator 12, the radiator 12 may also employ the so-called subcool condenser which has a subcooling portion for subcooling the liquid-phase refrigerant flowing out of the receiver 12*b*. As mentioned in the sixth embodiment, the radiator 12 constituted of only the condenser may be employed.

In the above-mentioned embodiments, the first evaporator 17 and the second evaporator 18 are integrated together by way of example. Alternatively, the first evaporator 17 and the second evaporator 18 may be configured separately from each other. The first evaporator 17 and the second evaporator 18 may cool different refrigerant target fluids within different temperature ranges.

The above-mentioned sixth embodiment has described an example of employing the air-heating expansion valve 23 and the first on-off valve 24*a*. However, the air-heating expansion valve 23 may employ one that has a fully-opening function of serving as a mere refrigerant passage by fully opening its valve opening degree almost without exhibiting any refrigerant decompression effect, as well as a completely-closing function of closing the refrigerant passage by completely closing the valve opening degree. Thus, the first on-off valve 24*a* and the first and second three-way joints 22*a* and 22*b* can be eliminated.

The above-mentioned embodiments employ, for example, R134a as the refrigerant, but the refrigerant is not limited thereto. For example, R1234yf, R600a, R410A, R404A, R32, R407C, etc., can be used. A mixed refrigerant or the like which is a mixture of some of these kinds of refrigerants may be used. A supercritical refrigeration cycle in which the high-pressure side refrigerant pressure is equal to or higher than the critical pressure of the refrigerant may be configured by using carbon dioxide as the refrigerant.

(4) The above-mentioned sixth embodiment has described an example of controlling the operation of the decompression-side driving mechanism 621 so as to fully open the throttle passage 20*a* of the ejector module 20 in the dehumidification heating mode. However, the operation of the decompression-side driving mechanism 621 is not limited thereto. The operation of the decompression-side driving mechanism 621 may be controlled to bring the throttle passage 20*a* into the throttle state, for example, on the operating condition in which the heating capacity of the radiator 12 for the ventilation air is sufficiently ensured.

(5) The devices or component element disclosed in the above-mentioned respective embodiments may be combined together within the feasible range as appropriate. For example, in the ejector module 20 of each of the first and fifth embodiments, the nozzle-side driving mechanism 541 described in the third embodiment and the decompression-side driving mechanism 621 described in the fourth embodiment may be employed at the same time. In other words, the ejector module 20 may also be employed which includes an electric variable throttle mechanism 16 and an electric variable nozzle.

The sixth embodiment has described an example of using the evaporator unit 200 that uses the ejector module 20 described in the fourth embodiment, in the ejector refrigeration cycle 10*a*. It is obvious that the evaporator unit 200 using the ejector module 20 described in the first to third embodiments may be used. In this case, the operation of the decompression-side driving mechanism 62 may be adjusted such that the throttle passage 20*a* is fully opened when the refrigerant having a relatively high dryness (for example, with a dryness of 0.5 or more) flows into the high-pressure inlet 21*a* of the ejector module 20.

What is claimed is:

1. An ejector module for use in an ejector refrigeration cycle, the ejector refrigeration cycle including: a compressor configured to compress and discharge a refrigerant; a radiator configured to dissipate heat from the refrigerant discharged from the compressor; a first evaporator configured to evaporate the refrigerant; and a second evaporator configured to evaporate the refrigerant and to cause the refrigerant to flow out to a suction side of the compressor, the ejector module comprising:

a nozzle configured to decompress a part of the refrigerant flowing out of the radiator and to inject the decompressed refrigerant;

a decompression portion configured to decompress another part of the refrigerant flowing out of the radiator;

a body portion having a refrigerant suction port, through which the refrigerant is drawn from an outside by a suction effect of an injection refrigerant injected from the nozzle;

a pressurizing portion configured to pressurize a mixed refrigerant of the injection refrigerant and a suction refrigerant drawn from the refrigerant suction port;

a decompression-side valve body configured to change a passage cross-sectional area of the decompression portion; and a decompression-side driving mechanism configured to displace the decompression-side valve body, wherein a throttle-side outlet through which the refrigerant flows out of the decompression portion is connected to a refrigerant inlet side of the first evaporator, the refrigerant suction port is connected to a refrigerant outlet side of the first evaporator, an ejector-side outlet through which the refrigerant flows out of the pressurizing portion is connected to a refrigerant inlet side of the second evaporator, and the decompression-side driving mechanism and a central axis of the nozzle are disposed to overlap each other when viewed from a direction of a decompression-side central axis, in a case where the decompression-side central axis is defined as a central axis of the decompression-side driving mechanism in a displacement direction in which the decompression-side driving mechanism displaces the decompression-side valve body.

2. The ejector module according to claim 1, wherein the decompression-side central axis and the central axis of the nozzle have a twisted positional relationship.

3. The ejector module according to claim 1, wherein the decompression-side driving mechanism displaces the decompression-side valve body such that a superheat degree of the refrigerant on an outlet side of the first evaporator approaches 0° C.

4. The ejector module according to claim 1, wherein at least a part of the pressurizing portion is provided to be accommodated in the second evaporator or in a pipe connected to the second evaporator by protruding from the body portion.

5. The ejector module according to claim 1, wherein the body portion is provided with a high-pressure inlet into which the refrigerant flowing out of the radiator flows, an outflow side passage through which the refrigerant flowing out of the second evaporator is guided to a suction port side of the compressor, a low-pressure inlet through which the refrigerant flows into the outflow side passage, and a low-pressure outlet through which the refrigerant flows out of the outflow side passage, the high-pressure inlet and the low-pressure outlet are opened in the same direction, and the ejector-side outlet, the low-pressure inlet, the refrigerant suction port, and the throttle-side outlet are opened in the same direction.

6. The ejector module according to claim 1, wherein the body portion has a high-pressure inlet into which the refrigerant flowing out of the radiator flows, and a maximum passage cross-sectional area of the decompression portion, obtained when the decompression-side driving mechanism displaces the decompression-side valve body, is equal to or more than a minimum passage cross-sectional area of a refrigerant passage that leads from the high-pressure inlet to the decompression portion.

7. The ejector module according to claim 1, wherein the decompression portion configured to decompress is a throttle passage formed in a rotary body shape and the pressurizing portion configured to pressurize is a diffuser.

8. The ejector module according to claim 1, wherein the body portion is provided with a suction side passage in which the refrigerant flowing out of the first evaporator flows, the decompression-side driving mechanism includes a decompression-side thermo-sensitive portion having a decompression-side deformation member that is deformable in accordance with a temperature and a pressure of the refrigerant flowing out of the first evaporator, and at least a part of the decompression-side thermo-sensitive portion is disposed in the suction-side passage or in a space communicating with the suction-side passage.

9. The ejector module according to claim 8, wherein the decompression-side deformation member is a decompression-side diaphragm.

10. An ejector module for use in an ejector refrigeration cycle, the ejector refrigeration cycle including: a compressor configured to compress and discharge a refrigerant; a radiator configured to dissipate heat from the refrigerant discharged from the compressor; a first evaporator configured to evaporate the refrigerant; and a second evaporator configured to evaporate the refrigerant and to cause the refrigerant to flow out to a suction side of the compressor, the ejector module comprising:

a nozzle configured to decompress a part of the refrigerant flowing out of the radiator and to inject the decompressed refrigerant;

a decompression portion configured to decompress another part of the refrigerant flowing out of the radiator;

a body portion that has a refrigerant suction port through which the refrigerant is drawn from an outside by a suction effect of an injection refrigerant injected from the nozzle;

a pressurizing portion configured to pressurize a mixed refrigerant of the injection refrigerant and a suction refrigerant drawn from the refrigerant suction port;

a nozzle-side valve body configured to change a passage cross-sectional area of the nozzle;

a nozzle-side driving mechanism configured to displace the nozzle-side valve body;

a decompression-side valve body configured to change a passage cross-sectional area of the decompression portion; and a decompression-side driving mechanism configured to displace the decompression-side valve body, wherein a throttle-side outlet through which the refrigerant flows out of the decompression portion is connected to a refrigerant inlet side of the first evaporator, the refrigerant suction port is connected to a refrigerant outlet side of the first evaporator, an ejector-side outlet through which the refrigerant flows out of the pressurizing portion is connected to a refrigerant inlet side of the second evaporator, a nozzle-side central axis is defined as a central axis of the nozzle-side driving mechanism in a displacement direction in which the nozzle-side driving mechanism displaces the nozzle-side valve body, and a decompression-side central axis is defined as a central axis of the decompression-side driving mechanism in a displacement direction in which the decompression-side driving mechanism displaces the decompression-side valve body, and when viewed from a central axis direction of each of the nozzle-side central axis and the decompression-side central axis, the driving mechanism corresponding to the nozzle-side central axis and the driving mechanism corresponding to the decompression-side central axis are respectively disposed to overlap with each other.

11. The ejector module according to claim 10, wherein the nozzle-side central axis and the decompression-side central axis have a twisted positional relationship.

12. The ejector module according to claim 10, wherein the decompression-side driving mechanism displaces the decompression-side valve body such that a superheat degree of the refrigerant on an outlet side of the first evaporator approaches 0° C.

13. The ejector module according to claim 10, wherein at least a part of the pressurizing portion is provided to be accommodated in the second evaporator or in a pipe connected to the second evaporator by protruding from the body portion.

14. The ejector module according to claim 10, wherein the body portion is provided with a high-pressure inlet into which the refrigerant flowing out of the radiator flows, an outflow side passage through which the refrigerant flowing out of the second evaporator is guided to a suction port side of the compressor, a low-pressure inlet through which the refrigerant flows into the outflow side passage, and a low-pressure outlet through which the refrigerant flows out of the outflow side passage, the high-pressure inlet and the low-pressure outlet are opened in the same direction, and the ejector-side outlet, the low-pressure inlet, the refrigerant suction port, and the throttle-side outlet are opened in the same direction.

15. The ejector module according to claim 10, wherein the body portion has a high-pressure inlet into which the refrigerant flowing out of the radiator flows, and a maximum passage cross-sectional area of the decompression portion, obtained when the decompression-side driving mechanism displaces the decompression-side valve body, is equal to or more than a minimum passage cross-sectional area of a refrigerant passage that leads from the high-pressure inlet to the decompression portion.

16. The ejector module according to claim 10, wherein the decompression portion configured to decompress is a throttle passage formed in a rotary body shape and the pressurizing portion configured to pressurize is a diffuser.

17. The ejector module according to claim 10, wherein the body portion is provided with an outflow side passage in which the refrigerant flowing out of the second evaporator flows, the nozzle-side driving mechanism is provided with a nozzle-side thermo-sensitive portion having a nozzle-side deformation member that is deformable in accordance with a temperature and a pressure of the refrigerant flowing out of the second evaporator, and at least a part of the nozzle-side thermo-sensitive portion is disposed in the outflow side passage or in a space communicating with the outflow side passage.

18. The ejector module according to claim 17, wherein the nozzle-side deformation member is a nozzle-side diaphragm.

19. The ejector module according to claim 10, wherein the body portion is provided with a suction side passage in which the refrigerant flowing out of the first evaporator flows, the decompression-side driving mechanism includes a decompression-side thermo-sensitive portion having a decompression-side deformation member that is deformable in accordance with a temperature and a pressure of the refrigerant flowing out of the first evaporator, and at least a part of the decompression-side thermo-sensitive portion is disposed in the suction-side passage or in a space communicating with the suction-side passage.

20. The ejector module according to claim 19, wherein the decompression-side deformation member is a decompression-side diaphragm.

* * * * *